US011930918B1

(12) United States Patent
Boren

(10) Patent No.: US 11,930,918 B1
(45) Date of Patent: Mar. 19, 2024

(54) PERSONAL CARE IMPLEMENTS

(71) Applicant: John R. Boren, Scottsdale, AZ (US)

(72) Inventor: John R. Boren, Scottsdale, AZ (US)

( * ) Notice: Subject to any disclaimer, the term of this patent is extended or adjusted under 35 U.S.C. 154(b) by 0 days.

(21) Appl. No.: 18/342,084

(22) Filed: Jun. 27, 2023

(51) Int. Cl.

| | |
|---|---|
| ***A46B 5/00*** | (2006.01) |
| ***A45D 29/12*** | (2006.01) |
| ***A46B 9/04*** | (2006.01) |
| ***A46B 9/06*** | (2006.01) |

(52) U.S. Cl.
CPC ..... *A46B 5/0016* (2013.01); *A45D 29/12* (2013.01); *A46B 9/04* (2013.01); *A46B 9/06* (2013.01); *A46B 2200/1006* (2013.01); *A46B 2200/1066* (2013.01)

(58) Field of Classification Search
CPC ... A46B 5/0016; A46B 5/0008; A46B 5/0012; A46B 9/04; A46B 9/06; A45D 29/12
See application file for complete search history.

(56) References Cited

U.S. PATENT DOCUMENTS

| | | | | | |
|---|---|---|---|---|---|
| 213,478 | A * | 3/1879 | White | A46B 9/023 | 132/308 |
| 1,868,368 | A * | 7/1932 | Reese | A46B 9/045 | 15/167.2 |
| 1,914,240 | A * | 6/1933 | Caldwell | A46B 5/002 | 15/167.1 |
| 2,095,741 | A * | 10/1937 | Hachman | A46B 7/044 | 15/176.6 |
| 2,528,992 | A * | 11/1950 | Barr | A46B 9/045 | 15/106 |
| 2,807,820 | A * | 10/1957 | Dinhofer | A46B 7/04 | 15/176.1 |
| 3,934,298 | A | 1/1976 | Kim | | |
| 4,131,967 | A * | 1/1979 | Northemann | A61C 17/34 | 15/167.2 |
| 4,150,457 | A * | 4/1979 | Larson | A46B 5/0016 | 15/167.1 |
| 4,185,349 | A | 1/1980 | Papas | | |
| 4,211,246 | A * | 7/1980 | Hokama | A45D 29/12 | 132/76.4 |
| 4,738,001 | A | 4/1988 | Shipp | | |
| 5,339,480 | A * | 8/1994 | Murg | A46B 3/18 | 15/160 |
| D389,313 | S | 1/1998 | Lolis | | |
| 5,842,249 | A * | 12/1998 | Sato | A46B 5/0008 | 15/207.2 |

(Continued)

*Primary Examiner* — Nicholas D Lucchesi
(74) *Attorney, Agent, or Firm* — Parsons & Goltry, PLLC; Michael W. Goltry; Robert A. Parsons

(57) ABSTRACT

A personal care implement has a handle including an elongate body having opposed first and second sides extending longitudinally between opposed proximal and distal ends, and first bristles attached fixedly to the elongate body. The first bristles form a scrub brush extending longitudinally of the elongate body between the proximal and distal ends, transversely of the elongate body between the first and second, and outward from the elongate body to a scrub-brushing extremity. An elongate member extends outward longitudinally from the distal end to a toothbrush head assembly. The toothbrush head assembly is of a first size to facilitate reception of the toothbrush head assembly in a mouth of a user for toothbrushing. The handle is of a second size larger than the first size to facilitate grasping and holding the handle by one hand of the user.

6 Claims, 12 Drawing Sheets

(56) References Cited

U.S. PATENT DOCUMENTS 6,168,434 B1 * 1/2001 Bohm-Van Diggelen ..... A46B 15/0073 132/308
6,286,173 B1 * 9/2001 Briones ..... A46B 9/045 D8/107
D485,441 S 1/2004 Lolis
8,763,193 B1 * 7/2014 Thompson ..... A46B 15/0055 D4/118
D792,108 S 7/2017 Lolis
9,968,183 B1 * 5/2018 Forrest ..... A46B 5/0016
D825,934 S 8/2018 Forrest
10,687,689 B1 * 6/2020 Antonucci ..... A47L 23/04
2002/0083539 A1 * 7/2002 Bella ..... A46B 7/04 15/176.1
2003/0046780 A1 * 3/2003 Davis ..... A46B 9/045 15/176.1
2004/0128782 A1 * 7/2004 Uskup ..... B08B 1/00 15/114
2006/0272113 A1 * 12/2006 Cato ..... A46B 9/025 15/167.1
2007/0151575 A1 * 7/2007 De Masi ..... A46B 15/0071 132/309
2009/0144921 A1 * 6/2009 Newsome ..... A46B 5/02 15/167.1
2012/0144612 A1 * 6/2012 Chen ..... A46B 9/04 15/167.1
2014/0311418 A1 * 10/2014 Jack ..... A01K 13/002 119/633
2015/0289636 A1 * 10/2015 Myers ..... A46B 15/0034 15/22.1
2016/0051040 A1 * 2/2016 Nadeau ..... A46B 5/0025 15/167.2
2017/0042303 A1 * 2/2017 Kock ..... A46B 7/044
2017/0215546 A1 * 8/2017 Debauge ..... A45D 24/04
2018/0310700 A1 * 11/2018 Cordero ..... A46B 5/0016

* cited by examiner

PERSONAL CARE IMPLEMENTS

FIELD OF THE INVENTION

The present invention relates to personal care implements and, more particularly, to personal oral and body care implements, such as toothbrushes and fingernail and hand brushes.

DESCRIPTION OF RELATED ART

Personal hygiene consists of practices performed by an individual conducive to one's health and well-being through cleanliness. Good personal hygiene, keeping the external body clean and healthy, is essential for maintaining physical and mental health.

Adhering to good dental and hand hygiene practices is important. A good dental hygiene routine prevents bad breath, cavities, gum disease, and tooth loss. Regular hand washing before, during, and after preparing food, before eating food, before and after looking after anyone who is vomiting or has diarrhea, before and after treating a cut or wound, after going to the bathroom, after changing diapers or cleaning up a child who has used the toilet, after blowing the nose, coughing, or sneezing, after touching garbage or dirty surfaces or objects, and after handling pets or pet-related items helps to avoid the spread of communicable diseases.

Various configurations of toothbrushes are well-known and commonly employed to maintain good dental hygiene. Various configurations of special-purpose hand and fingernail brushes are well-known and commonly employed to maintain good hand and fingernail hygiene. People who practice good dental hygiene routinely use toothbrushes to brush their teeth to remove food particles, plaque, and other debris from around the teeth and gums. People who practice good hand and fingernail hygiene often use hand and fingernail brushes to brush over, around and under their fingernails, the front, palm, or palmar side of the hand, and the back or dorsal side of the hand to remove dirt, debris, bacteria and other contaminants from the hand and around and under the fingernails.

Most dentists recommend brushing teeth for two minutes, twice daily, with an equal thirty seconds brushing each quadrant of teeth, namely, the lower left, lower right, upper left, and upper right quadrants. Most experts in preventing infections or the spread of infectious diseases recommend frequent handwashing, including brushing the hand and fingernails with special-purpose brushes. However, some people may not brush their teeth, wash their hands, and brush their hands and fingernails as often as recommended because of complacency, forgetfulness, lack of habit, or lack of readily-accessible brushes. Accordingly, there is a need for personal care implements configured for and to promote frequent toothbrushing and brushing of the hands and fingernails.

SUMMARY OF THE INVENTION

According to the principle of the invention, a personal care implement has a handle including an elongate body having opposed first and second sides extending longitudinally between opposed proximal and distal ends, and first bristles attached fixedly to the elongate body. The first bristles, arranged in tufts, form a scrub brush extending longitudinally of the elongate body between the proximal and distal ends, transversely of the elongate body between the first and second sides, and outward from the elongate body to a scrub-brushing extremity. An elongate member extends outward longitudinally from the distal end to a toothbrush head assembly, including second bristles attached fixedly to a head. The second bristles, arranged in tufts, form a toothbrush extending outward from the head to a toothbrushing extremity. The toothbrush head assembly is of a first size to facilitate reception of the toothbrush head assembly in a mouth of a user for toothbrushing. The handle is of a second size larger than the first size to facilitate grasping and holding the handle by one hand of the user in a first format, the elongate body grasped between a thumb of the hand of the user against one of the first and second sides between the proximal and distal ends and four fingers of the hand of the user spaced longitudinally against another one of the first and second sides between the proximal and distal ends, and a second format, the thumb and four fingers of the hand of the user wrapped around the handle with a palm side of the hand in direct contact against the scrub-brushing extremity, inducing a grasping reflex by the hand of the user. The scrub-brushing extremity is flat. The first and second sides include axially spaced apart first and second flanges. The head has opposed root and outer ends and extends outward from the root end affixed to the elongate member to the outer end. The toothbrush extends longitudinally of the head between the root and outer ends. The implement has a length from the proximal end of the handle to the outer end of the head. The handle has a length from the proximal end to the distal end, the length of the handle at least 45% of the length of the implement. The scrub brush has a length between the proximal and distal ends, the length of the scrub brush at least 80% of the length of the handle.

According to the principle of the invention, a personal care implement has a handle including an elongate body having opposed front and back faces and opposed first and second sides extending longitudinally between opposed proximal and distal ends, front bristles attached fixedly to the elongate body and rear bristles attached fixedly to the elongate body. The front bristles, arranged in tufts, form a front scrub brush extending longitudinally of the elongate body between the proximal and distal ends, transversely of the elongate body between the first and second sides, and forwardly from the front face to a forward-facing scrub-brushing extremity. The rear bristles, arranged in tufts, form a rear scrub brush extending longitudinally of the elongate body between the proximal and distal ends, transversely of the elongate body between the first and second sides, and rearwardly from the back face to a rearward-facing scrub-brushing. An elongate member extends outward longitudinally from the distal end to a toothbrush head assembly, including toothbrush bristles attached fixedly to a head. The toothbrush bristles, arranged in tufts, form a toothbrush extending outward from the head to a toothbrushing extremity. The toothbrush head assembly is of a first size to facilitate reception of the toothbrush head assembly in a mouth of a user for toothbrushing. The handle is of a second size larger than the first size to facilitate grasping and holding the handle by one hand of the user in a first format, the elongate body grasped between a thumb of the hand of the user against one of the first and second sides between the proximal and distal ends and four fingers of the hand of the user spaced longitudinally against another one of the first and second sides between the proximal and distal ends, and a second format, the thumb and four fingers of the hand of the user wrapped around the handle with a palm side of the hand in direct contact against the forward-facing scrub-brushing extremity and the rearward-facing scrub-brushing extremity, inducing a grasping reflex by the hand of the user. The forward-facing scrub-brushing extremity is flat. The rearward-facing scrub-brushing extremity is flat. The front scrub brush and the rear scrub brush are axially spaced apart. The forward-facing scrub-brushing extremity is parallel to the rearward-facing scrub-brushing extremity. The first and second sides include axially spaced apart first and second flanges. The head has opposed root and outer ends and extends outward from the root end affixed to the elongate member to the outer end. The toothbrush extends longitudinally of the head between the root and outer ends. The implement has a length from the proximal end of the handle to the outer end of the head. The handle has a length from the proximal end to the distal end, the length of the handle at least 45% of the length of the implement. The front scrub brush has a length between the proximal and distal ends, the length of the front scrub brush at least 80% of the length of the handle. The rear scrub brush has a length between the proximal and distal ends, the length of the rear scrub brush at least 80% of the length of the handle.

BRIEF DESCRIPTION OF THE DRAWINGS

Specific objects and advantages of the invention will become apparent to those skilled in the art from the following detailed description of illustrative embodiments thereof, taken in conjunction with the drawings in which.

DETAILED DESCRIPTION

Figure 2:
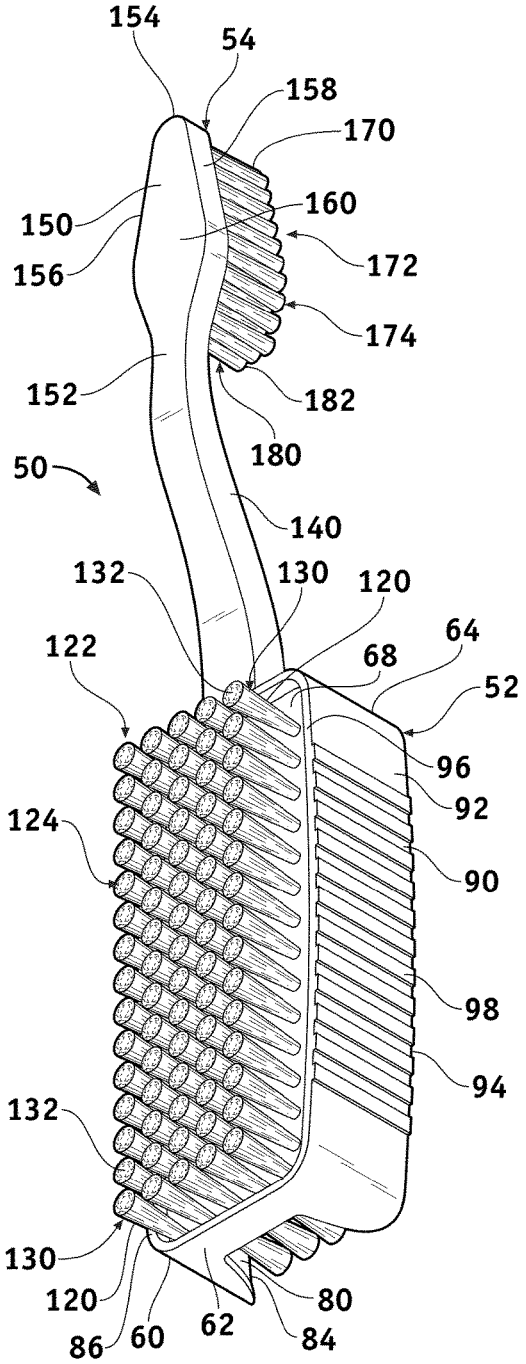
FIG. 2 is a rear perspective view of the embodiment of FIG. 1.
Figure 1:
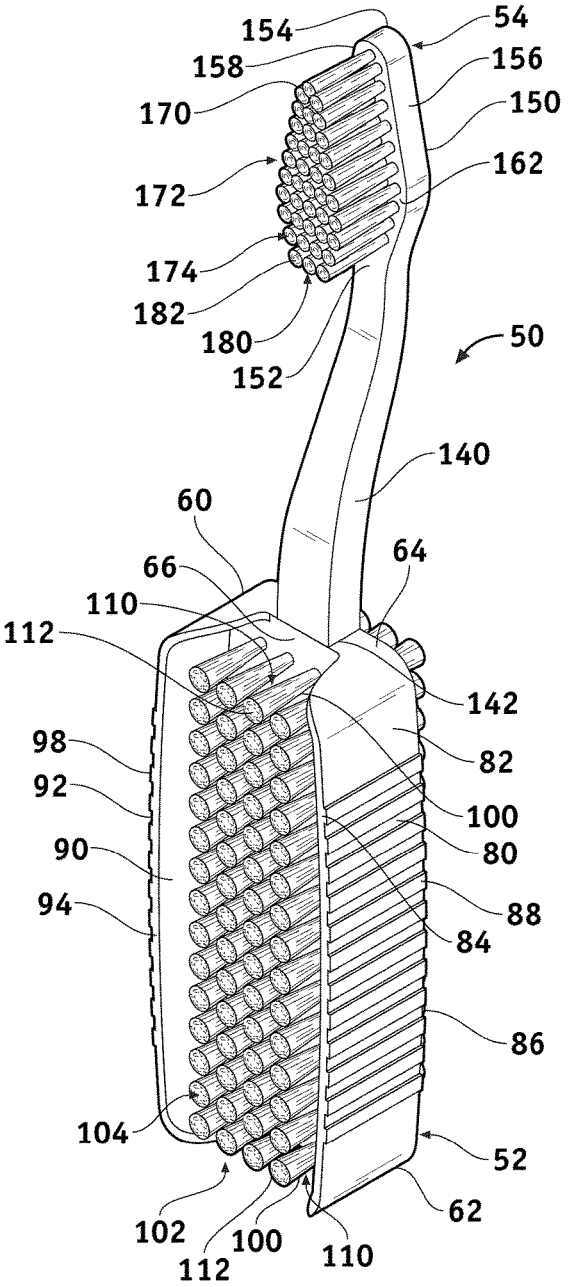
FIG. 1 is a front perspective view of a personal care implement constructed and arranged according to the principle of the invention, the personal care implement including a handle configured with scrub brushes and an elongate member extending outward longitudinally from the handle to a toothbrush head assembly.

Disclosed are personal care implements, each including a handle configured with at least one scrub brush for hand and fingernail brushing and a toothbrush head assembly for toothbrushing. The personal care implements are useful for maintaining good dental, hand, and fingernail hygiene, promote frequent hand and fingernail washing in conjunction with frequent toothbrushing and vice versa, and are simple in structure, inexpensive, and easy to use. Since the personal care implements each integrate a toothbrush head assembly configured for toothbrushing and at least one scrub brush configured for hand and fingernail washing, each of the personal care implements allows a user to selectively brush his teeth with the toothbrush head assembly and brush his hands and fingernails with the scrub brush. Whether a user sets out to brush his teeth or wash his hands, the personal care implements juxtaposing a toothbrush head assembly with a hand and fingernail scrub brush not only provides the user with the ability to do both but also beneficially induces or reminds the user, an ordinary observer, to do both. In other words, the look and feel of a personal care implement constructed and arranged according to the invention, its appearance and functionality that the user, the ordinary observer, will notice, how it juxtaposes a toothbrush head assembly with a hand and fingernail scrub brush, inherently induces the user to brush his teeth with the toothbrush head assembly while holding the implement in either his right hand or his left hand, wash his left hand and its fingernails with the scrub brush while holding the implement in his right hand, and wash his right hand and its fingernails with the scrub brush while holding the implement in his left hand. The configurations of the personal care implements disclosed herein are less expensive and more convenient compared to separate, special-purpose brushes. The personal care implements disclosed herein promote increased frequency of tooth, hand, and fingernail brushing, with resultant health benefits. The described usefulness and beneficial attributes of a personal care implement constructed and arranged according to the invention apply to each personal care implement disclosed herein.

I

Turning to the drawings, like reference characters indicating corresponding elements throughout the several views, FIGS. 1-6 illustrate a personal care implement 50 constructed and arranged according to the invention. The implement 50 includes a handle 52 and a toothbrush head assembly 54. The head assembly 54 is of size to facilitate and allow its reception in a mouth of a user for toothbrushing, the user being a human user. The handle 52, the part of the implement 50 adapted to be grasped or held by one hand of the user, is of a second size larger than that of the head assembly 54 to facilitate grasping and holding the handle 52 by one hand of the user for taking up and wielding the implement 50 by one hand.

Referring to FIGS. 1-6 relevantly, the handle 52 exemplifies and hand and fingernail scrub brush construction. It includes a body 60 of plastic, metal, or other material or a combination of materials with inherently strong, rigid, and resilient material characteristics. The body 60 includes a proximal end 62, a distal end 64, opposed surfaces or faces 66 and 68, and opposed flange 80 and 90. Face 66 is the body's 60 front face, and face 68 is the body's 60 back face. Flange 80 defines one side of the body 60, and flange 90 defines the other side of the body 60. Flange 80 is the body's 60 left flange, defining the body's 60 left side. Flange 90 is the body's 60 right flange, defining the body's 60 right side. For reference purposes and ease of discussion, reference character 80 refers interchangeably to the body's 60 left flange and the body's 60 left side, and reference character 90 refers interchangeably to the body's 60 right flange and the body's 60 right side. The body 60 is elongate from the proximal end 62 to the distal end 64. The front and the back faces 66 and 68 of the body's 60 central section or web extending between the opposed sides 80 and 90 are flat and parallel. The opposed front and back faces 66 and 68 and the opposed sides 80 and 90 extend longitudinally of the body 60 between the opposed proximal and distal ends 62 and 64. The opposed front and back faces 66 and 68 and the opposed proximal and distal ends 62 and 64 extend transversely of the body 60 between the opposed sides 80 and 90.

The flanges 80 and 90 have respective outer surfaces 82 and 92, are coextensive, equal in size and shape, axially spaced apart, extend longitudinally of the body 60 between the proximal and distal ends 62 and 64, project forward of the front face 64 to their forward-most longitudinal marginal edges 84 and 94, and rearward of the back face 68 to their rearward-most longitudinal marginal edges 86 and 96. In this example, the extents of the respective flanges 80 and 90 extending forward of the front face 66 to their respective edges 84 and 94 are larger than the extents of the respective flanges 80 and 90 extending rearward of the back face 68 to their respective edges 86 and 96. The extents of the respective flanges 80 and 90 extending forward of the front face 66 are coextensive, equal in size and shape, and spaced apart axially. The extents of the respective flanges 80 and 90 extending rearward of the back face 68 are coextensive, equal in size and shape, and spaced apart axially. The flanges 80 and 90 of the respective left and right sides 80 and 90 of the body 60 facilitate grasping and holding the handle 52 by one hand of the user. Protruding ribs 88 of the outer surface 82 of flange 80 and protruding ribs 98 of the outer surface 92 of flange 90 aid in gripping the respective flanges 80 and 90 by one hand of the user.

Figure 3:
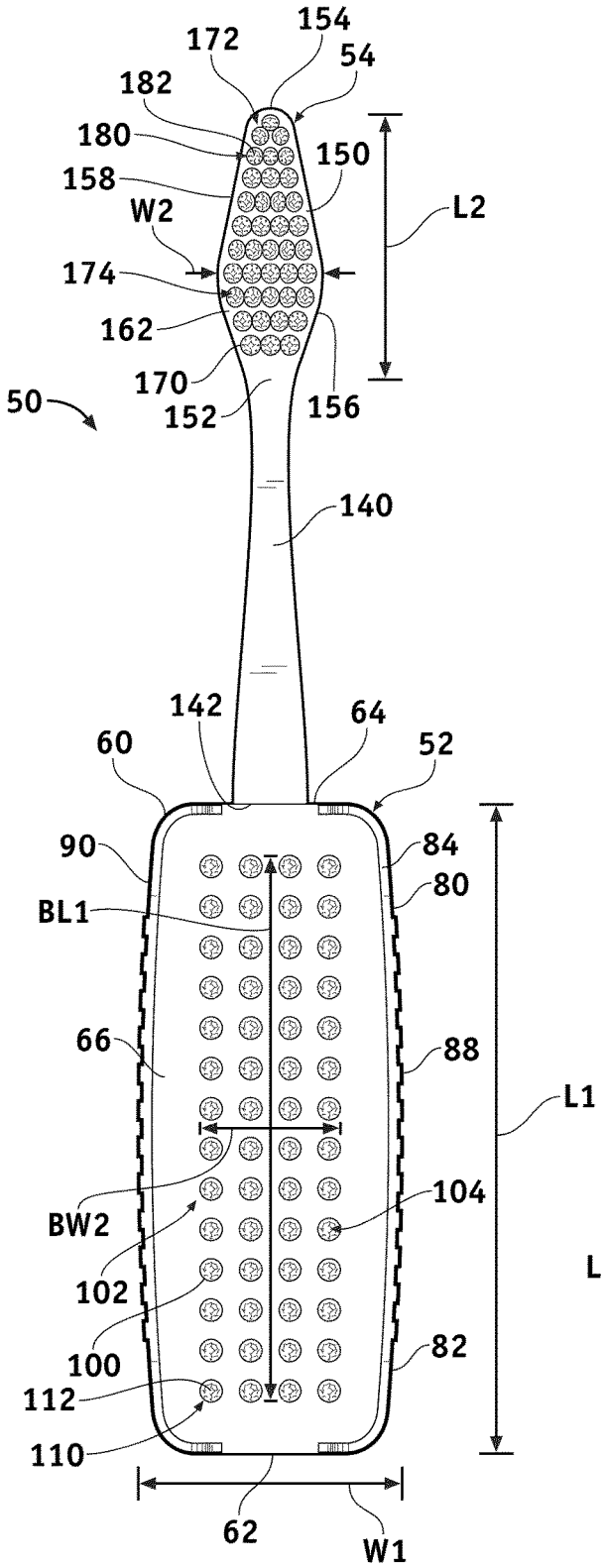
FIG. 3 is a front elevation view of the embodiment of FIG. 1.
Figure 4:
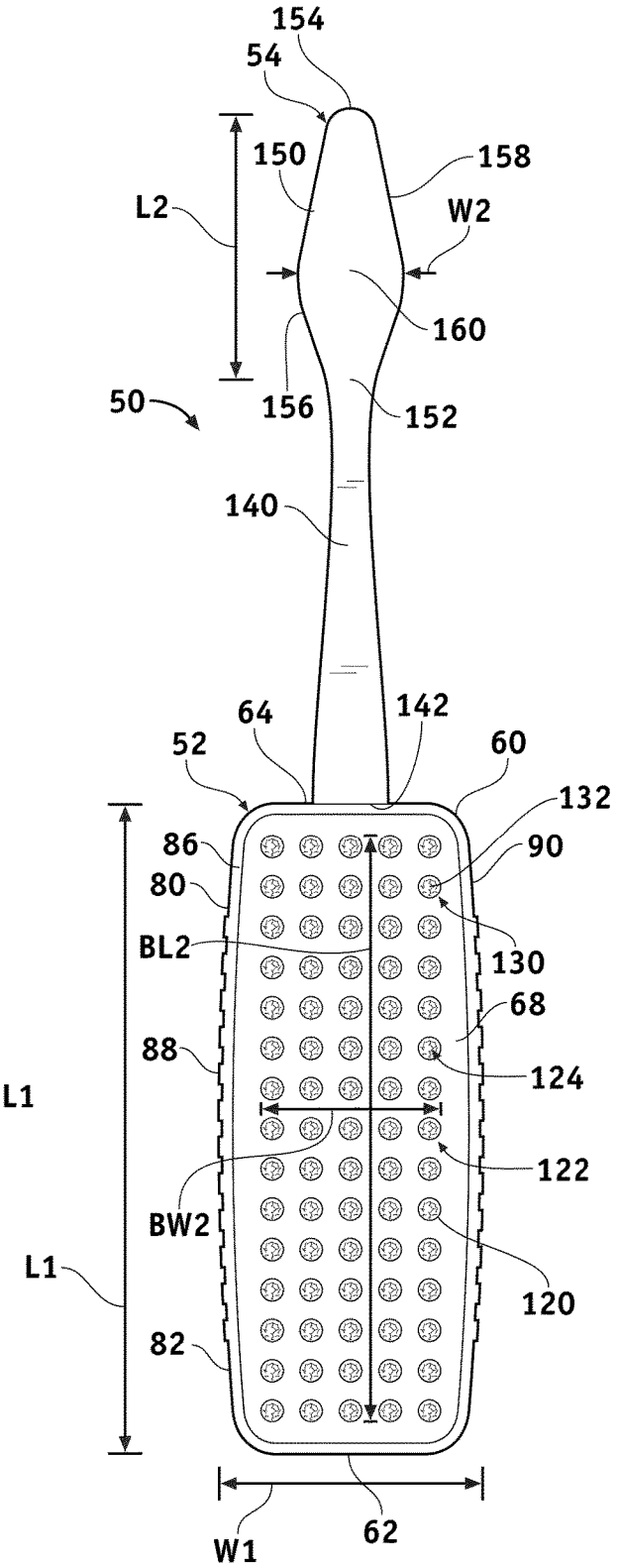
FIG. 4 is a rear elevation view of the embodiment of FIG. 1.

Referring to FIGS. 3 and 4, the body 60 has a length L1 from the proximal end 62 to the distal end 64 and a width W1 from the flange's 80 outer surface 82 to the flange's 90 outer surface 92. The body 60 is elongate from its proximal end 62 to its distal end 64, its length L1 being longer than its width W2.

The handle 52 has front bristles 100 and rear bristles 120, attached fixedly to the body 60. The front bristles 100 are flexible and resilient, of polyester, nylon, or the like, attached or embedded into the body 60 in a manner well-known in the art and form a front scrub brush 102 designed for cleaning the surfaces of the hands and fingernails. The scrub brush 102 extends longitudinally of the body 60 between the proximal and distal ends 62 and 64, along a length of the body 60 from proximate to the proximal end 62 to proximate to the distal end 64, transversely of the body 60 between the sides 80 and 90, along a width of the body 60 from proximate to side 80 to proximate to side 90, and outward forwardly from the front face 66 to a forward-facing scrub-brushing extremity 104. In this example, the scrub brush 102 has a rectangular shape, its brush length BL1 in FIG. 3 extending longitudinally of the body 60 between the proximal end distal ends 62 and 64 being longer than its brush width BW1 in FIG. 3 extending transversely of the body 60 between the sides 80 and 90.

The front bristles 100 are arranged in tufts 110. The tufts 90 are identical in every respect. Each tuft 110 extends forward of the front face 66 to a brushing extremity 112. The various tufts 110 define the scrub brush 102, and their various brushing extremities 112 define the scrub brush's 102 scrub-brushing extremity 104.

The extents of the flanges 80 and 90 extending forward of the front face 66 to their respective edges 84 and 94 flank either side of the scrub brush 100 extending forward of the front face 66 to its scrub-brushing extremity 104. The scrub-brushing extremity 104 is flat, parallel to the front face 66, and resides proximate to the plane occupied by the edges 84 and 94 of the respective flanges 80 and 90 extending longitudinally along either side of the long sides of the scrub brush 102 between the proximal and distal ends 62 and 64.

The rear bristles 120 are flexible and resilient, of polyester, nylon, or the like, attached or embedded into the body 60 in a manner well-known in the art and form a rear scrub brush 122 designed for cleaning the surfaces of the hands and fingernails. The scrub brush 122 extends longitudinally of the body 60 between the proximal and distal ends 62 and 64, along a length of the body 60 from proximate to the proximal end 62 to proximate to the distal end 64, transversely of the body 60 between the sides 80 and 90, along a width of the body 60 from proximate to side 80 to proximate to side 90, and outward rearwardly from the back face 68 to a rearward-facing scrub-brushing extremity 124. In this example, the scrub brush 122 has a rectangular shape, its brush length BL2 in FIG. 4 extending longitudinally of the body 60 between the proximal end distal ends 62 and 64 being longer than its brush width BW2 in FIG. 4 extending transversely of the body 60 between the sides 80 and 90.

The rear bristles 120 are arranged in tufts 130. The tufts 130 are identical in every respect. Each tuft 130 extends rearward of the back face 68 to a brushing extremity 132. The various tufts 130 define the scrub brush 122 and their various brushing extremities 132 define the scrub brush's 122 scrub-brushing extremity 124. The body's 60 central web has a thickness between its faces 66 and 68 sufficient to accommodate the front bristles 100 and the rear bristles 120 attached or embedded therein.

The extents of the respective flanges 80 and 90 extending rearward of the back face 68 to their respective edges 86 and 96 flank either side of the scrub brush 122 extending rearward of the back face 68 and beyond the edges 86 and 86 of the respective flanges 80 and 90 to its scrub-brushing extremity 124. The scrub-brushing extremity 124 is flat and parallel to the back face 68, the front face 66, and the scrub-brushing extremity 104 of the scrub brush 102. The scrub brushes 102 and 122 are axially spaced apart and extend outwardly in opposite directions from the body 60, the scrub brush 102 extending outward forwardly of the body 60, and the scrub brush 122 extending outward rearwardly of the body 60.

Figure 7:
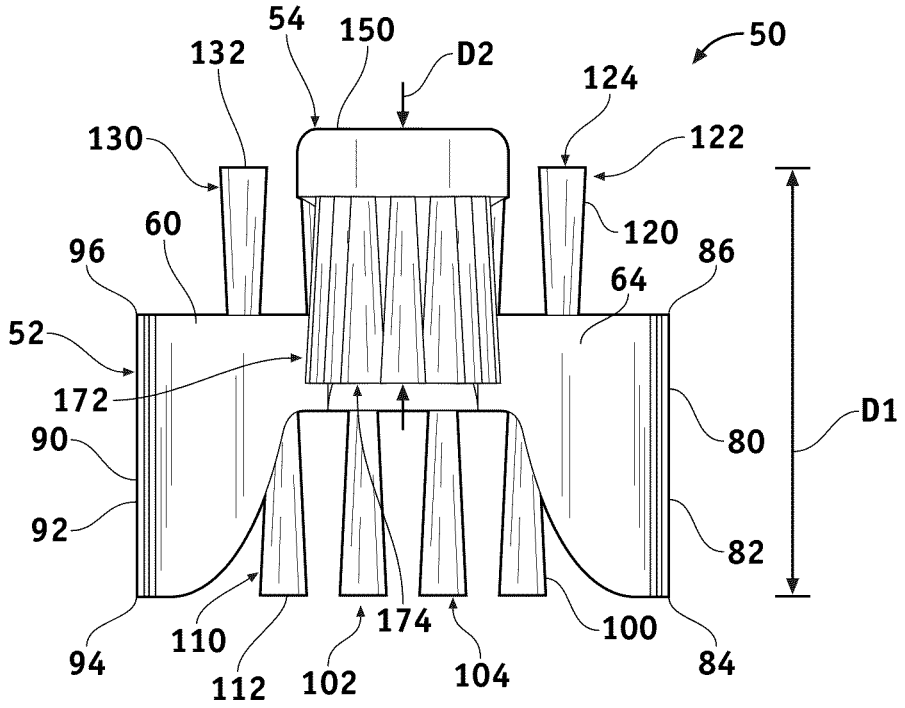
FIG. 7 is a top plan view of the embodiment of FIG. 1.
Figure 8:
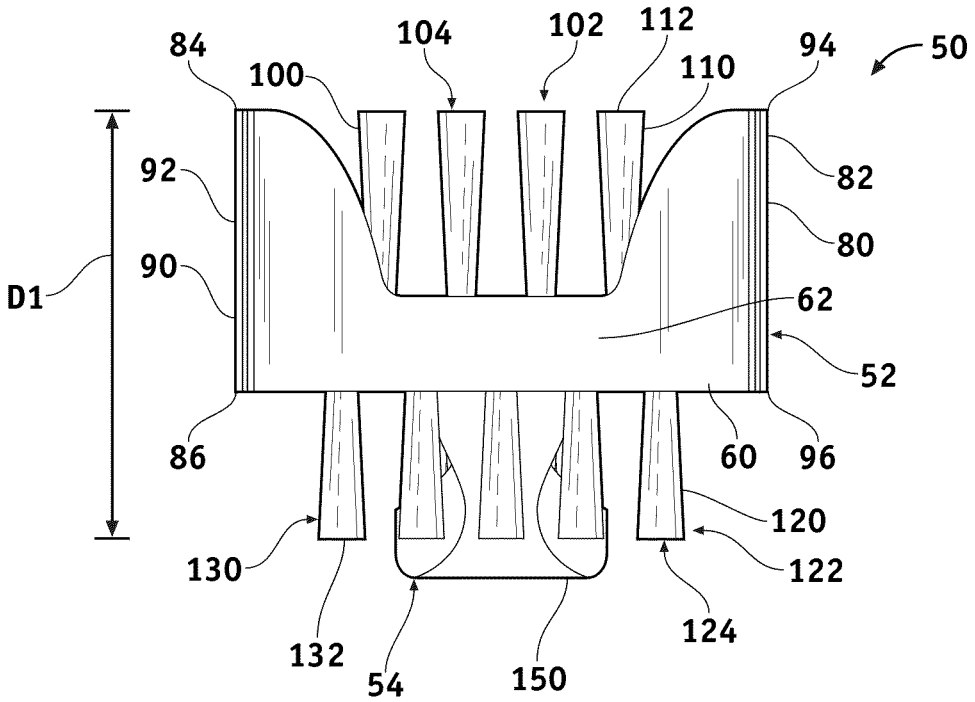
FIG. 8 is a bottom plan view of the embodiment of FIG. 1.

As explained above, the body 60 has a length L1 from the proximal end 62 to the distal end 64 and a width W1 from the flange's 80 outer surface 82 to the flange's 90 outer surface 92. The length L1 of the body 60 is the length of the handle 52. The width W1 of the body 60 is the width of the handle 52. In FIGS. 7 and 8, the depth D1 of handle 52 is from the rear-facing scrub-brushing extremity 104 and the edges 86 and 96 of the respective flanges 80 and 90 to the forward-facing scrub-brushing extremity 104.

An elongate member 140 or neck connects the head assembly 54 to the handle 52. The elongate member 140, not a part of the handle 52 and of the same material as the body 60, extends outward longitudinally from body's 60 distal end 64 to the head assembly 54. The elongate member 140 extends longitudinally outwardly from its inner end 142, affixed rigidly to the handle's 52 distal end 64 centrally between the opposed sides 80 and 90, to the head assembly 54.

The head assembly 54 includes toothbrush bristles 170 attached fixedly to a head 150 having root end 152, an outer end 154, opposed sides 156 and 158, and opposed faces 160 and 162. In this example, side 156 is the head's 150 left side, side 158 is the head's 150 right side, face 160 is the head's 150 back face, and face 162 is the head's 150 front face. The toothbrush bristles 170 are flexible and resilient, of nylon, rubber stainless steel, titanium, or the like, attached or embedded into the head 150 in a manner well-known in the art and form a toothbrush 172 designed for toothbrushing.

The elongate member 140 extends longitudinally outwardly from its inner end 142 affixed to the handle's 52 distal end 64 to the head's 150 root end 152. The head 150 extends outward longitudinally from its root end 152 to its outer end 154. The elongate member 140 and the head 150 are a single, unitary body in a preferred embodiment. The toothbrush 172 extends longitudinally of the head 150 between the root and outer ends 152 and 154, transversely of the head 150 between the head's 150 sides 156 and 158, and outward forwardly in the same direction as the scrub brush 82 from the head's 150 front face 162 to the toothbrush's 172 toothbrushing extremity 174. The implement 50 extends longitudinally from the proximal end 62 to the distal end 64, from the inner end 142 of the elongate member 140 to the head's 150 root end 152, and from there to the head's 150 outer end 154.

The toothbrush bristles 160 are arranged in tufts 180. The tufts 180 are identical in every respect. Each tuft 180 extends outward of the head's 150 front face 162 to a brushing extremity 182. The various tufts 180 define the toothbrush 172, and their various brushing extremities 182 define the toothbrush's 172 toothbrushing extremity 174. In alternate embodiments, the tufts 180 and the toothbrush 172 they form can extend outward rearwardly in the same direction as the scrub brush 122 or another chosen direction.

Figure 5:
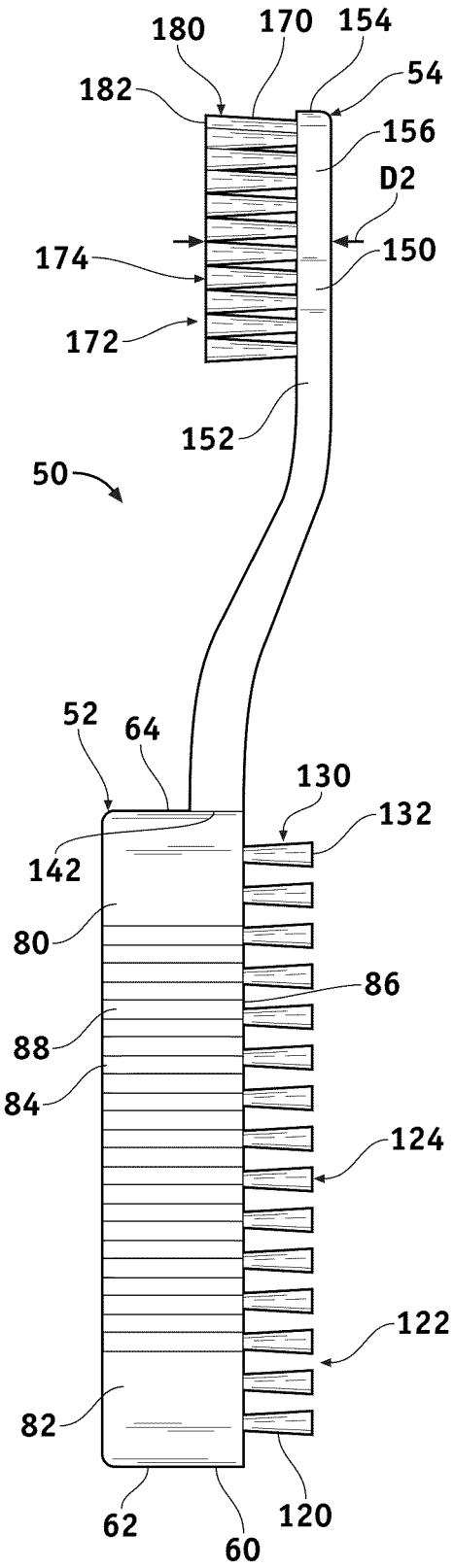
FIG. 5 is a left side elevation view of the embodiment of FIG. 1.
Figure 6:
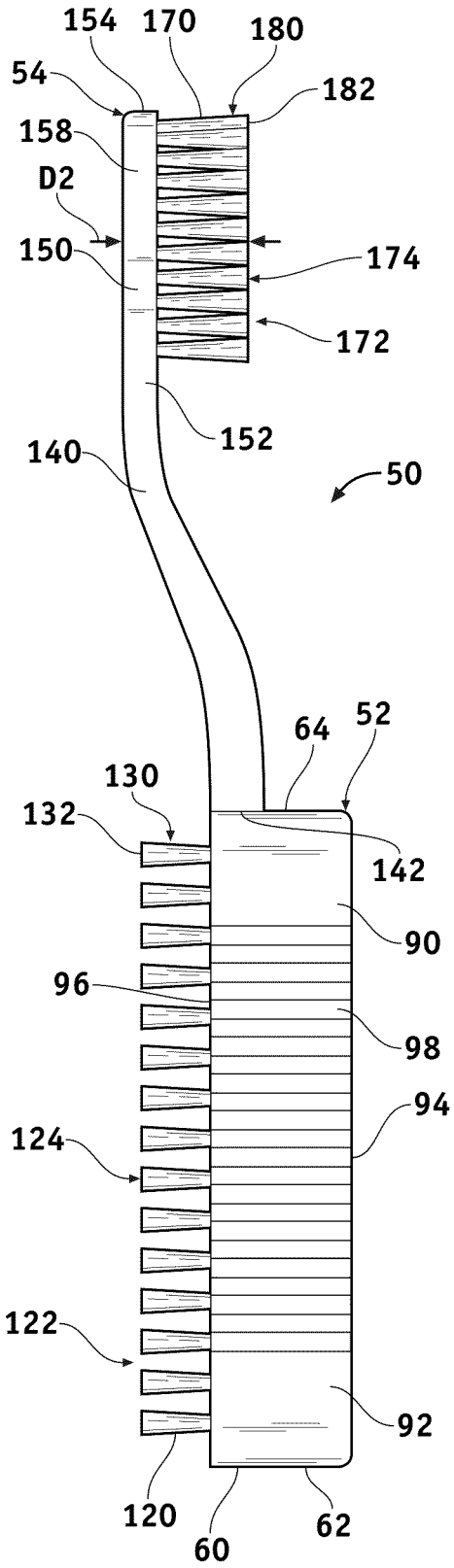
FIG. 6 is a right side elevation view of the embodiment of FIG. 1.

In FIGS. 3 and 4, the head assembly 54 has a length L2 extending longitudinally from the root end 152 to the outer end 154, and a width W2 extending transversely from side 156 to side 158. In FIGS. 5 and 6, the head assembly 54 also has a depth D2 extending from the head's 150 face 160 to the toothbrush's 172 toothbrushing extremity 174.

The implement 50 is useful for toothbrushing with the head assembly 54 and hand and fingernail washing with the handle's 52 front and rear scrub brushes 82 and 102. The head assembly 54 is of a size to facilitate and allow its reception in the mouth of the user for toothbrushing. The handle 52 is of a size larger than that of the head assembly 54 to facilitate and allow grasping and holding the handle 52 by one of his hands, as shown in FIGS. 9-18. The juxtaposition of the head assembly 54 and the handle's 52 scrub brush 102 beneficially remind and induce the user to scrub one of his hands and its fingernails with the scrub brush 102 of the implement 50 while holding the implement's 50 handle 52 by his other hand in conjunction with the user's regular, preferably twice daily, use of the implement 50 for toothbrushing, and vice versa. The user can switch holding the implement 50 between his hands as needed for brushing his teeth with the head assembly 54 and brushing his hands and their respective fingernails with the handle's 52 brushes 102 and 122. This expedient induces and promotes a frequency of hand and fingernail washing commensurate with a frequency of toothbrushing, customarily a twice-daily routine.

The configuration of the implement's 50 handle 52 allows the user to grasp it by one hand in various formats, i.e., grasp formats, for wielding the implement 50 for brushing teeth, hands, and fingernails, explained below. In exemplary embodiments, written instructions explaining how the user should grasp the implement's 50 handle 52 as described below accompany the implement 50 sold in commerce, such as on the implement's 50 packaging, literature accompanying the implement 50, on the implement 50 itself, etc., which applies to each implement embodiment disclosed herein.

Figure 10:
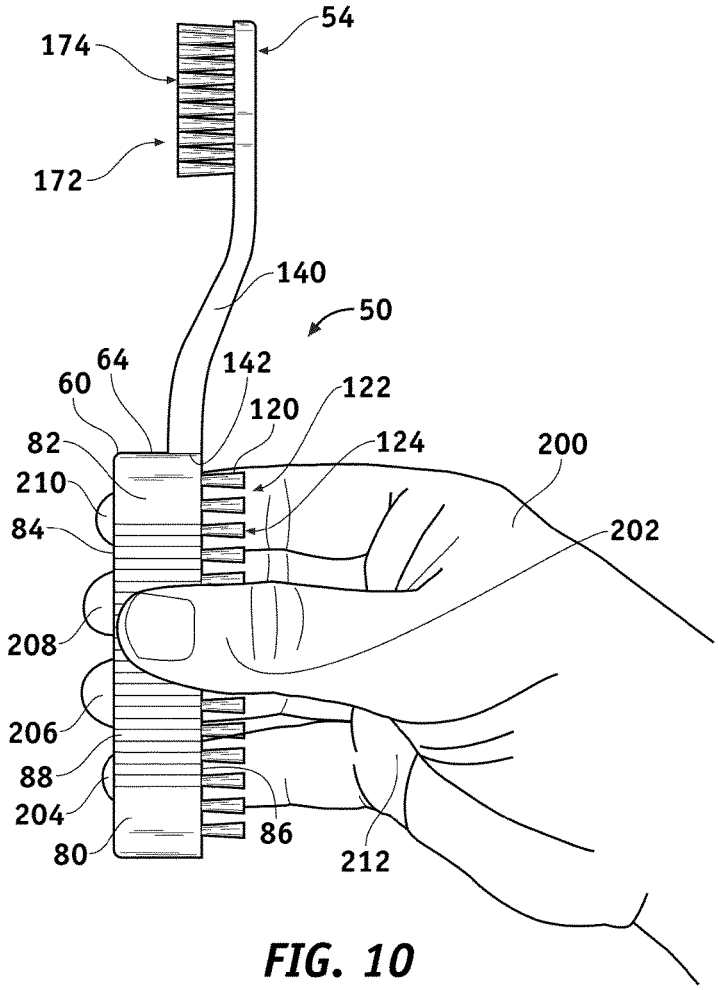
FIG. 10 is a side elevation view of the embodiment of FIG. 9.
Figure 9:
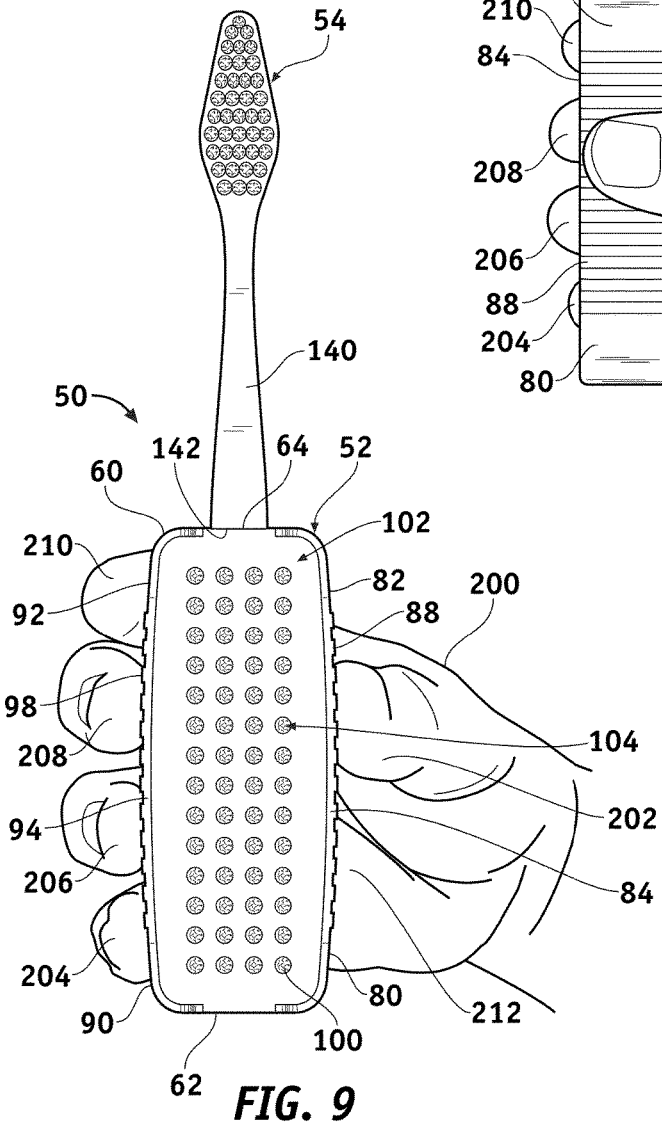
FIG. 9 is a view corresponding to FIG. 3, illustrating the handle grasped between a thumb and four fingers of one hand of a user.
Figure 11:
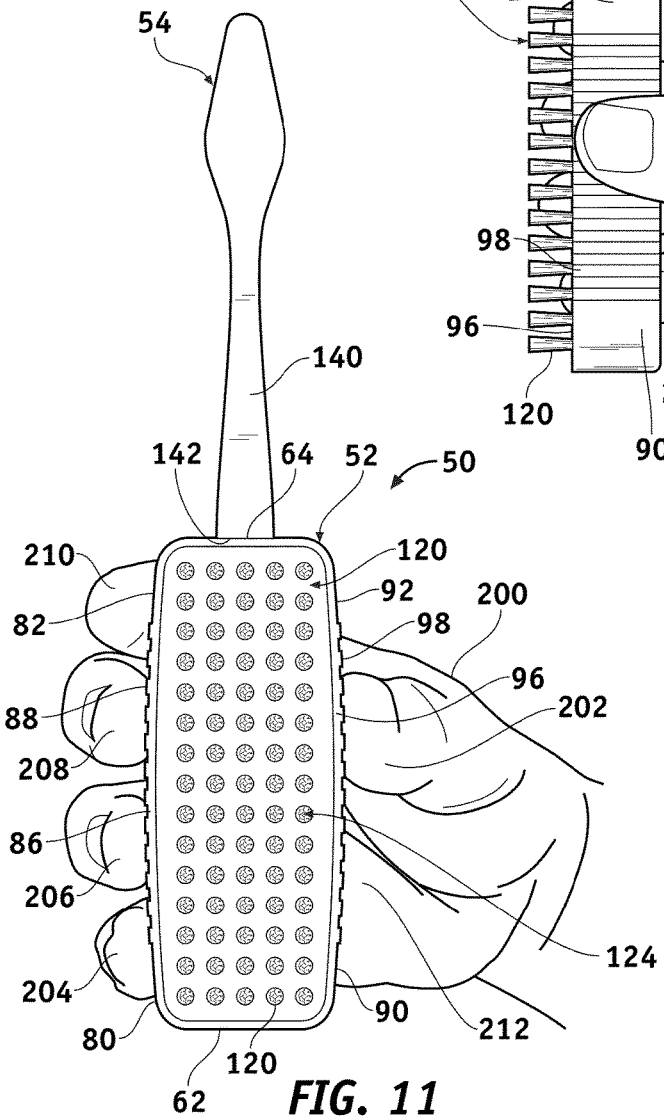
FIG. 11 is a perspective view of the embodiment of FIG. 9, illustrating the handle grasped between the thumb and four fingers of the one hand of the user opposing another hand of the user.

FIGS. 9-11 illustrate the handle 52 grasped by one hand 200 of the user according to a first format, the body 60 grasped between a thumb 202 of the right hand 200 of the user against the outer surface 82 of the flange 80 of the body's 60 side 80 between the body's 60 proximal and distal ends 62 and 64 and four fingers, the pinky finger 204, the ring finger 206, the middle finger 208, and the index finger 210, of the hand 200 of the user spaced longitudinally against the outer surface 92 of the flange 90 of the body's 60 side 90 between the body's 60 proximal and distal ends 62 and 64, the ribs 88 of the outer surface 82 of the flange 80 and the ribs 98 of the outer surface 92 of the flange 90 aiding in gripping the respective flanges 80 and 90 by the hand 200 of the user. The implement 50 extends upright through the user's hand 200 from the proximal end 62 below the user's pinky finger 204, the lowermost finger of the user's hand 200 against the flange's 90 outer surface 92, to the distal end 64 extending beyond the user's thumb 202 against the flange's 80 outer surface 82 and his index finger 210, the uppermost finger of the user's hand 200 against the flange's 90 outer surface 92. The elongate member 140 extends upright from the body's 60 distal end 64 to the head assembly 54, the handle's 52 scrub brush 102 extends outward from a palm side 212 side of the user's hand 200 to its scrub-brushing extremity 104, and the handle's 52 scrub brush 122 extends inward toward the palm side 212 of the user's hand 200 to its scrub-brushing extremity 124. The user hand holding the implement's 50 handle 52 by his hand 200 in this way can maneuver the head assembly 54 into his mouth and brush his teeth with it in a customary manner. He can also scrub his other hand, his left hand 220 in FIG. 11, with the outwardly-facing scrub-brushing extremity 104 of the handle's 52 scrub brush 102 without changing his grasp of the handle 52.

FIGS. 9-11 illustrate the handle 52 grasped by the user's right hand 200. The grasp according to the first format is reversed when the handle 52 is grasped by his left hand.

When the handle 52 is grasped by his left hand, the body 60 would grasped between a thumb of the user's left hand against the outer surface 92 of the flange 90 of the body's 60 side 90 between the body's 60 proximal and distal ends 62 and 64 and the four fingers of the user's left hand spaced longitudinally against the outer surface 82 of the flange 80 of the body's 60 side 80 between the body's 60 proximal and distal ends 62 and 64. The implement 50 would extend upright through the user's hand 200 from the proximal end 62 below the user's left pinky finger, the lowermost finger of the user's left hand against the flange's 80 outer surface 82 adjacent to the proximal end 62, to the distal end 64 extending beyond the user's left thumb against the flange's 90 outer surface 92 and his left index finger, the uppermost finger of the user's left hand against the flange's 80 outer surface 82 adjacent to the distal end 64. The user hand holding the implement's 50 handle 52 by his left hand in this way can maneuver the head assembly 54 into his mouth and brush his teeth with it in a customary manner. He can also scrub his right hand with the outwardly-facing scrub-brushing extremity 104 of the handle's 52 scrub brush 102 without changing his grasp of the handle 52.

Figure 12:
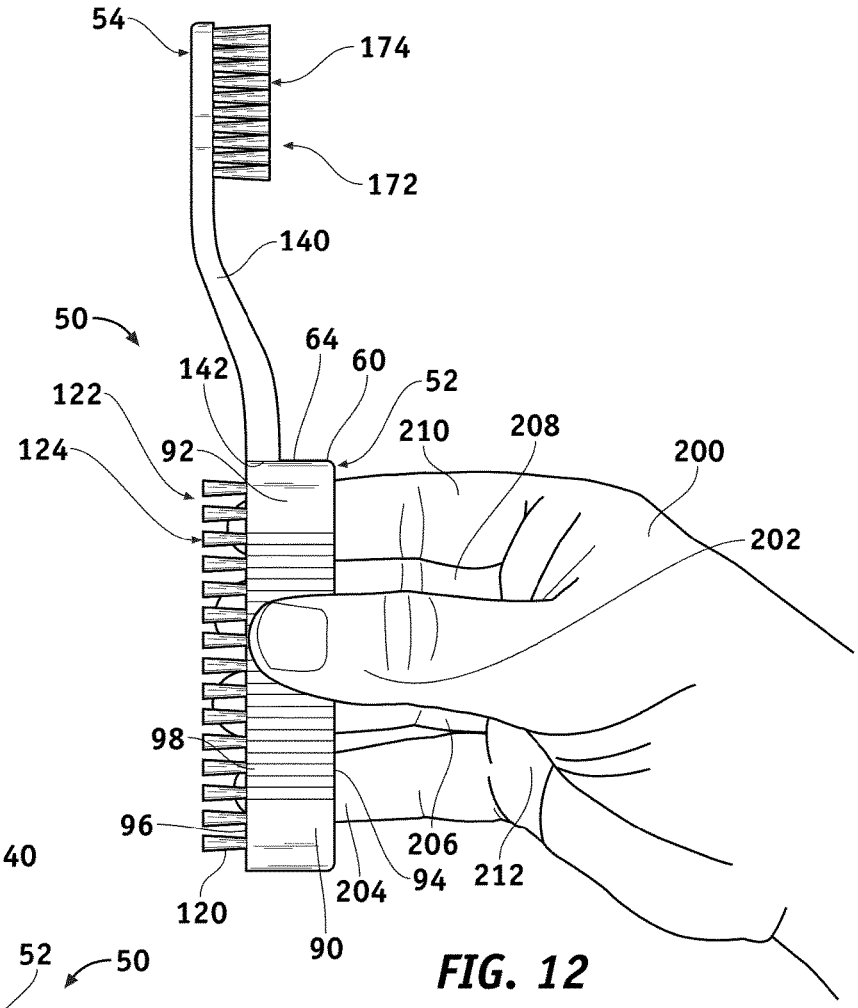
FIG. 12 is a view corresponding to FIG. 4, illustrating the handle grasped between a thumb and four fingers of one hand of a user.
Figure 13:
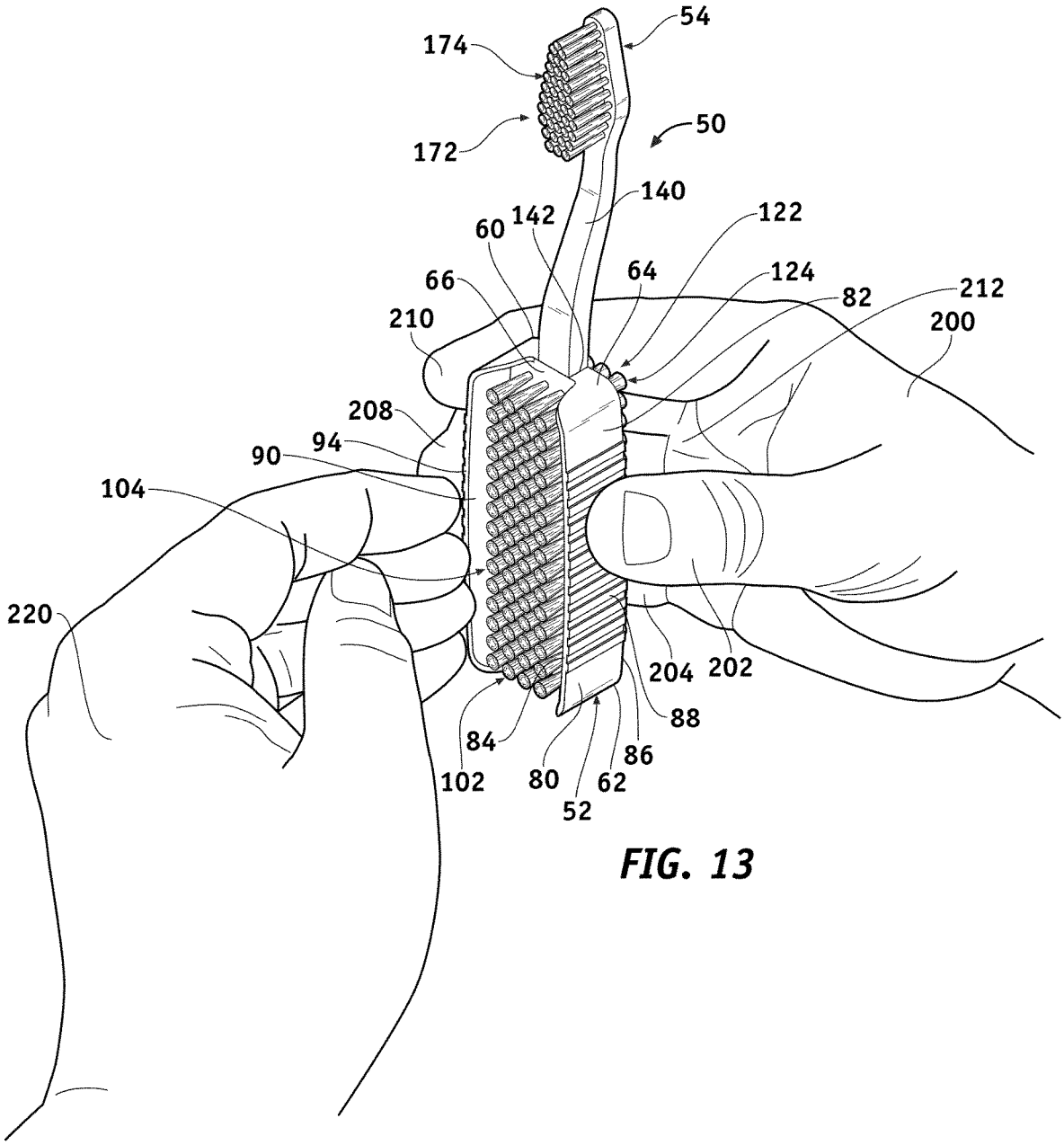
FIG. 13 is a side elevation view of the embodiment of FIG. 12.
Figure 14:
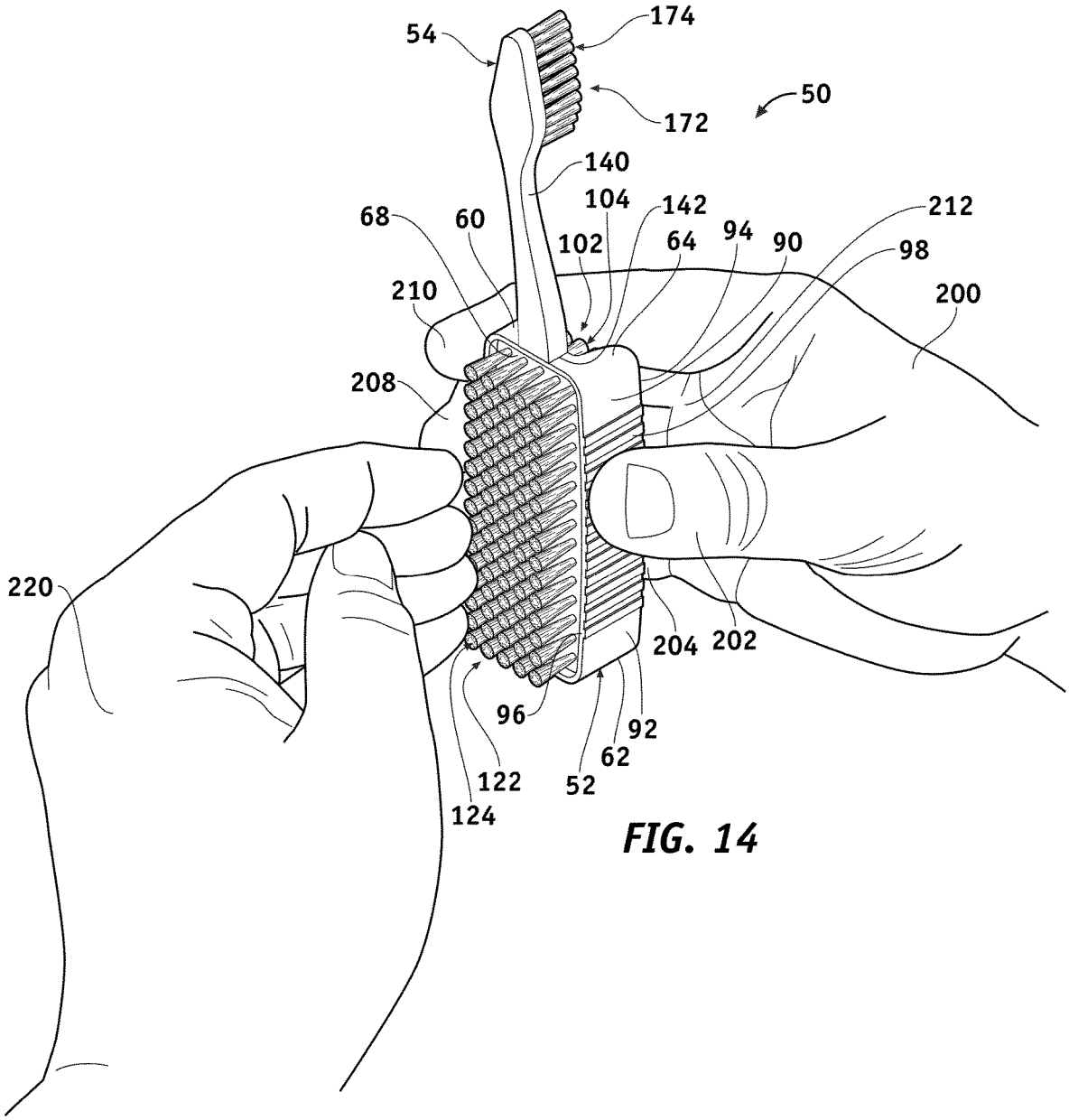
FIG. 14 is a perspective view of the embodiment of FIG. 12, illustrating the handle grasped between the thumb and four fingers of the one hand of the user opposing another hand of the user.

FIGS. 12-14 illustrate the handle 52 grasped by one hand of the user, the user's right hand 200, according to another first format mode, the body 60 grasped between the thumb 202 of the hand 200 of the user against the outer surface 92 of the flange 90 of the body's 60 side 90 between the body's 60 proximal and distal ends 62 and 64 and four fingers, the pinky finger 204, the ring finger 206, the middle finger 208, and the index finger 210, of the hand 200 of the user spaced longitudinally against the outer surface 82 of the flange 80 of the body's 60 side 80 between the body's 60 proximal and distal ends 62 and 64, the ribs 88 of the outer surface 82 of the flange 80 and the ribs 98 of the outer surface 92 of the flange 90 aiding in gripping the respective flanges 80 and 90 by the hand 200 of the user. The implement 50 extends upright through the user's hand 200 from the proximal end 62 below the user's pinky finger 204, the lowermost finger of the user's hand 200 against the flange's 80 outer surface 82 adjacent to the proximal end 62, to the distal end 64 extending beyond the user's thumb 202 against the flange's 90 outer surface 92 and his index finger 210, the uppermost finger of the user's hand 200 against the flange's 80 outer surface 82 adjacent to the distal end 64. The elongate member 140 extends upright from the body's 60 distal end 64 to the head assembly 54, the handle's 52 scrub brush 122 extends outward from the palm side 212 side of the user's hand 200 to its scrub-brushing extremity 124, and the handle's 52 scrub brush 102 extends inward toward the palm side 212 of the user's hand 200 to its scrub-brushing extremity 104. The user hand holding the implement's 50 handle 52 by his hand 200 in this way can maneuver the head assembly 54 into his mouth and brush his teeth with it in a customary manner. He can also scrub his other hand, his left hand 220 in FIG. 14, with the outwardly-facing scrub-brushing extremity 124 of the handle's 52 scrub brush 122 without changing his grasp of the handle 52.

FIGS. 12-14 illustrate the handle 52 grasped by the user's right hand 200. The grasp is reversed when the handle 52 is grasped by his left hand. When the handle 52 is grasped by his left hand, the body 60 would grasped between a thumb of the left hand of the user against the outer surface 82 of the flange 80 of the body's 60 side 90 between the body's 60 proximal and distal ends 62 and 64 and the four fingers of the user's left hand spaced longitudinally against the outer surface 92 of the flange 90 of the body's 60 side 80 from and between the body's 60 proximal and distal ends 62 and 64. The implement 50 would extends upright through the user's hand 200 from the proximal end 62 below the user's left pinky finger, the lowermost finger of the user's left hand against the flange's 90 outer surface 92 adjacent to the proximal end 62, to the distal end 64 extending beyond the user's left thumb against the flange's 80 outer surface 82 and his left index finger, the uppermost finger of the user's left hand against the flange's 90 outer surface 92 adjacent to the distal end 64. The user hand holding the implement's 50 handle 52 by his left hand in this way can maneuver the head assembly 54 into his mouth and brush his teeth with it in a customary manner. He can also scrub his right hand with the outwardly-facing scrub-brushing extremity 124 of the handle's 52 scrub brush 122 without changing his grasp of the handle 52.

FIGS. 15-18 illustrate the handle 52 grasped by one hand 200 of the user according to a second format, a first grip including the thumb 202 and four fingers 202, 204, 206, 208, and 210 of the hand 200 of the user wrapped around the handle 52 with the palm side 212 of the hand 200 in direct contact against the scrub-brushing extremities 104 and 124 of the respective scrub brushes 102 and 122, inducing, surprisingly, a grasping reflex by the hand 200 of the user in response to the tactile sensation produced by the scrub-brushing extremities 104 and 104 in direct contact with the palm side 212 of the user's hand 200. The inherent flexible and resilient material characteristics of the bristles of the respective scrub brushes 102 and 122 allows them to deflect and return to their original shape when the user repeatedly first grips the handle 52 forcibly. The implement 50 extends upright through the user's hand 200 fist-gripping the handle 52 from the proximal end 62 below the user's pinky finger 204, the lowermost finger of the user's hand 200 wrapped around the handle 52 adjacent to the proximal end 62, to the distal end 64 extending beyond the user's thumb 202 and index finger 210, the uppermost fingers of the user's hand 200 wrapped around the handle 52 adjacent to the distal end 64. The elongate member 140 extends upright from the body's 60 distal end 64 to the head assembly 54. The user hand holding the implement's 50 handle 52 by his hand 200 in this way can maneuver the head assembly 54 into his mouth and brush his teeth with it in a customary manner.

The expedient of the inducement of the grasping reflex by the hand 200 of the user in response to the tactile sensation produced by the scrub-brushing extremities 104 and 104 in direct contact with the palm side 212 of the user's hand 200 when the user's hand 220 fist-grips the handle 52 has the added advantages of improving and developing the user's hand 200 strength, resilience, and blood flow therethrough, especially after repeated use of the implement 50 for brushing his teeth regularly, such as twice daily. The therapeutic effects effectuated by the hand acting on the handle 52 by the grasping reflex, improving and developing the user's hand 200 strength, resilience, and blood flow therethrough, is especially advantageous for people in need of such therapeutic effects.

Figure 16:
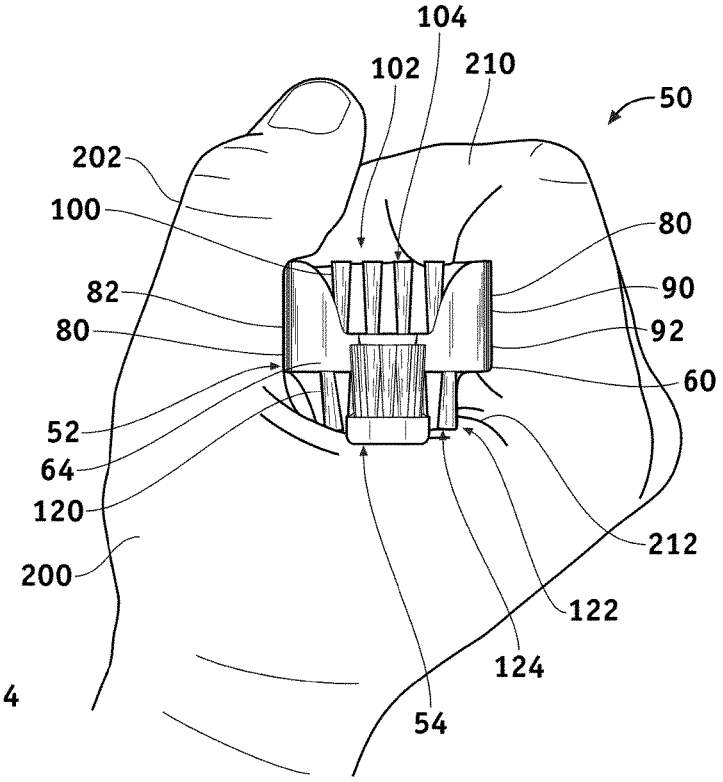
FIG. 16 is a top plan view of the embodiment of FIG. 15.
Figure 15:
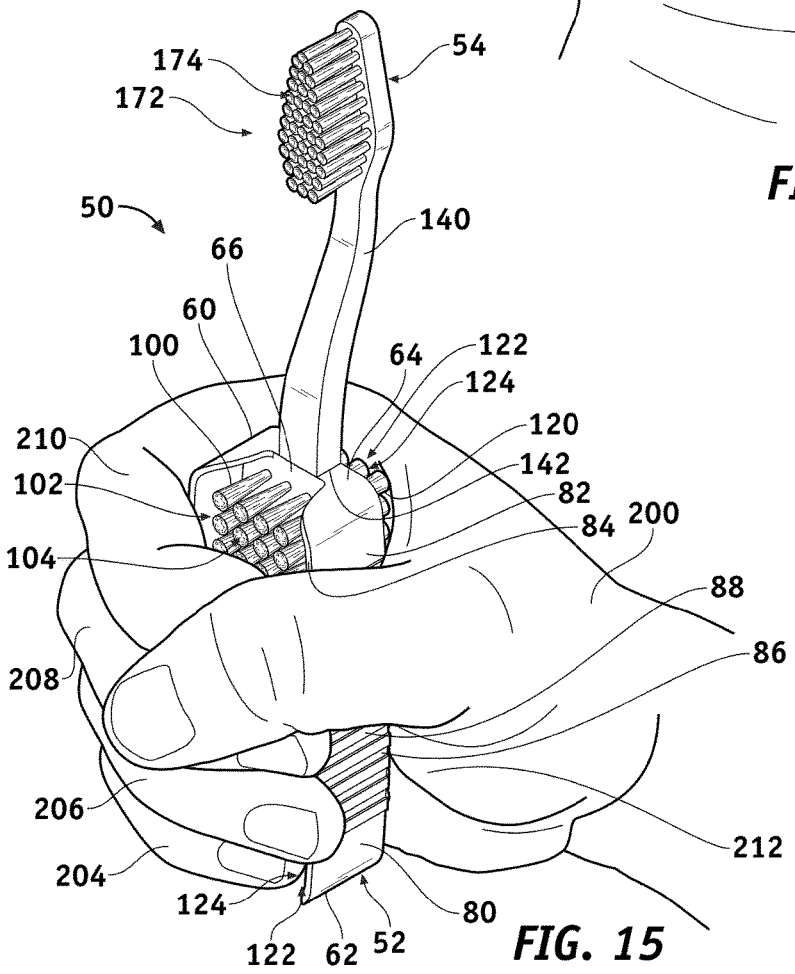
FIG. 15 is a view corresponding to FIG. 1, illustrating a thumb and four fingers of a hand of a user wrapped about and grasping the handle.
Figure 18:
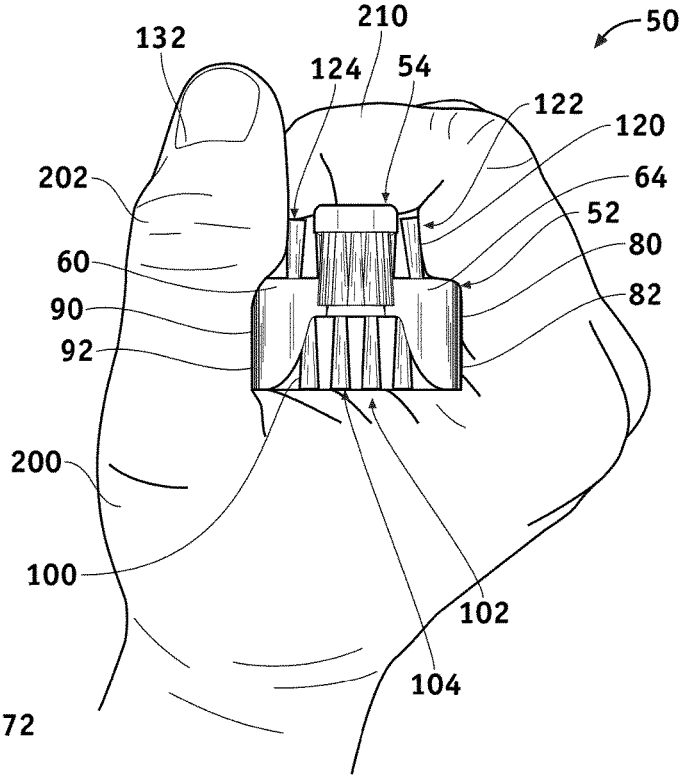
FIG. 18 is a top plan view of the embodiment of FIG. 17.
Figure 17:
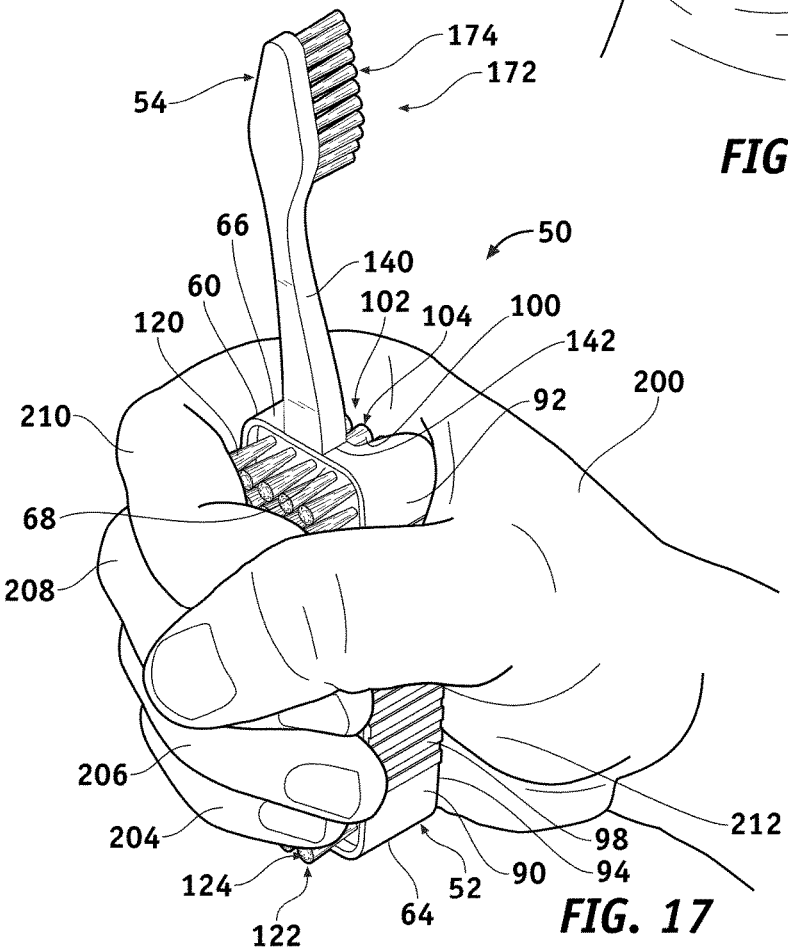
FIG. 17 is a view corresponding to FIG. 2, illustrating a thumb and four fingers of a hand of a user wrapped about and grasping the handle.

In FIGS. 15 and 16, the palm sides 212 of the four fingers 202, 204, 206, 208, and 210 are directly against the scrub-brushing extremity 104 of the scrub brush 102, and the palm side 212 of the hand's 200 palm is directly against the scrub-brushing extremity 124 of the scrub brush 122. FIGS. 17 and 18 show the handle 52 orientated so the palm sides 212 of the four fingers 202, 204, 206, 208, and 210 are directly against the scrub-brushing extremity 124 of the scrub brush 122 and the palm side 212 of the hand's 200 palm is directly against the scrub-brushing extremity 104 of the scrub brush 102. The user can first grip the handle 52 to direct the respective scrub-brushing extremities 104 and 124 against other parts of the palm side 212 of the user's hand 200 as desired. The user can also first grip the handle 52 in the same way with his left hand.

As explained above, the head assembly 54 is of a size that facilitates and allows its reception in the mouth of the user for toothbrushing, and the handle 52 is of a size larger than that of the head assembly 54 that facilitates and allows grasping and holding the handle 52 by one hand of the user as shown and described. In a particular example, the handle's 52 length L1 is 9 centimeters, its width W1 is 3.5 centimeters, and its depth D1 is 3.5 centimeters. The scrub brush's 102 brush length BL1 is 7.3 centimeters, at least 80%, between 81% and 82% in this example, of the handle's 52 length L1, and its brush width BW2 is 1.6 centimeters, at least 45% of the handle's 52 width W1. The scrub brush's 122 brush length BL2 is 7.6 centimeters, at least 80%, between 83% and 84% in this example, of the handle's 52 length L1, and its brush width BW2 is 2.5 centimeters, at least 70%, between 71% and 72% in this example, of the handle's 52 width W1.

Compared to the handle's 52 dimensions, those of the head assembly 54 is considerably smaller. The head assembly's 54 length L2 is 2.5 centimeters, less than 30%, between 27% and 28% in this example, of the handle's 52 length L1, less than 35%, between 34% and 35% in this example, of the brush's 102 brush length BL1, and less than 35%, between 32% and 33% in this example, of the brush's 122 brush length BL2. The head assembly's 54 width W2 is 1.3 centimeters, less than 40%, between 37% and 38% in this example, of the handle's 52 width W1, less than 85%, between 81% and 82% in this example, of the brush's 102 brush width BW1, and no less than 50%, being 52% in this example, of the brush's 122 brush width BW2. The head assembly's 54 depth D2 is 1.5 centimeters, less than 45%, between 42% and 43% in this example, of the handle's 52 width D1. In this example, the implement's 50 overall length L in FIGS. 3 and 4 from the handle's 52 proximal end 62 to the head assembly's 54 outer end 154 is 20 centimeters. Accordingly, the head assembly's 54 length L2 is less than 15%, between 12% and 13% in this example, of the implement's 50 length L, the handle's 52 length L1 is at least 45% of the implement's 50 length L, the brush's 102 length BL1 is at least 35%, between 36% and 37% in this example, of the implement's 50 length L, and the brush's 102 brush length BL2 is at least 35%, 38% in this example, of the implement's 50 length L.

According to this disclosure, the size of the head assembly 54, determined by its described dimensions relative to the corresponding dimensions of the handle 52 and the length L of the implement 50, while too small to be grasped by the grasp formats described above, is suitably sized to facilitate and allow its reception in the mouth of the user for toothbrushing. The size of the handle 52, determined by its described dimensions relative to the corresponding dimensions of the head assembly 54 and the length L of the implement 50, while too big for reception in the mouth of the user for toothbrushing, is suitably sized to facilitate and allow the handle 52 to be grasped by one hand of the user as shown and described. Accordingly, the size and the configuration of the head assembly 54 do not allow the head assembly 54 to be grasped by the grasp formats described above but rather make it suitable or otherwise useful for toothbrushing, i.e., to brush teeth. At the same time, the size and configuration of the handle 52 do not allow the handle 52 to be used for toothbrushing, i.e., to brush teeth, but rather make it suitable to be grasped by the grasp formats described above. The illustrative dimensions of the head assembly 54 are by way of example, as are the dimensions of the handle 52. The dimensions of the head assembly 54 and the corresponding dimensions of the handle 52 can vary, +/−0-20%, consistent with the teachings presented herein.

The implement's 50 handle 52 is designed to be grasped by one hand of the user for wielding the implement 50 according to the formats described above. The user can, of course, hold the implement 50 by its handle 52 in any way the user chooses. The body's 60 proximal end 62 is flat between the opposed faces 66 and 68 and between the opposed sides 80 and 90. This expedient allows the implement 50 to be supported upright from its proximal end 62 resting upon a horizontal supporting surface, such as the surface of a countertop, sink, etc.

II

Figure 19:
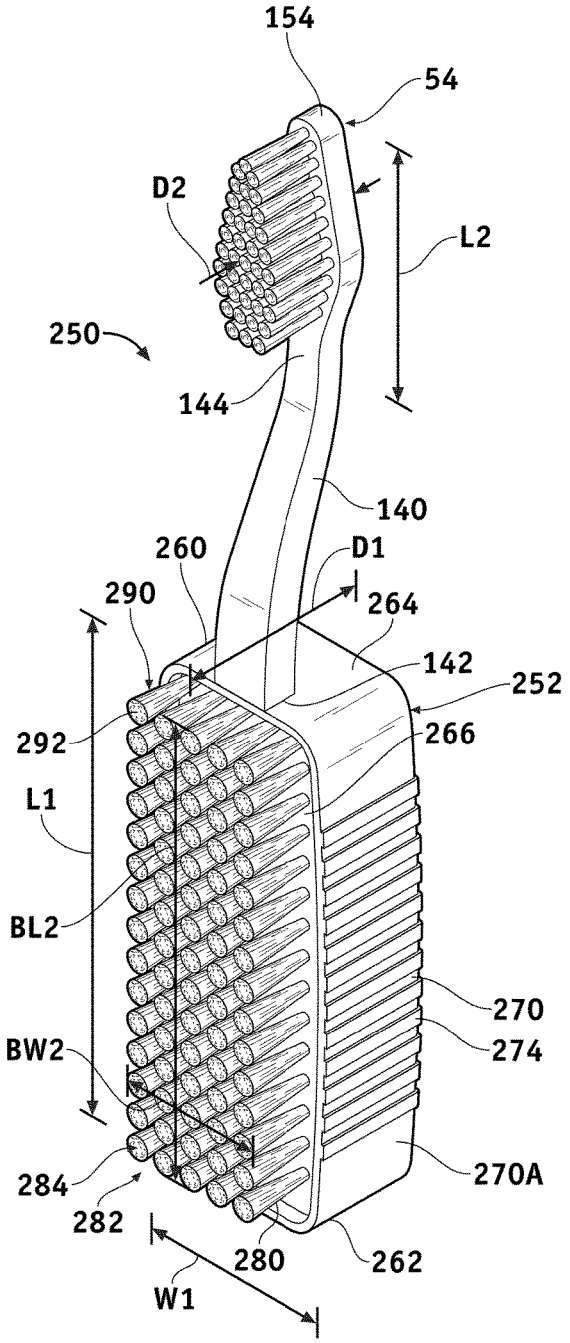
FIG. 19 is a front perspective view of another embodiment of a personal care implement constructed and arranged according to the principle of the invention, the personal care implement including a handle configured with a scrub brush and an elongate member extending outward longitudinally from the handle to a toothbrush head assembly.
Figure 20:
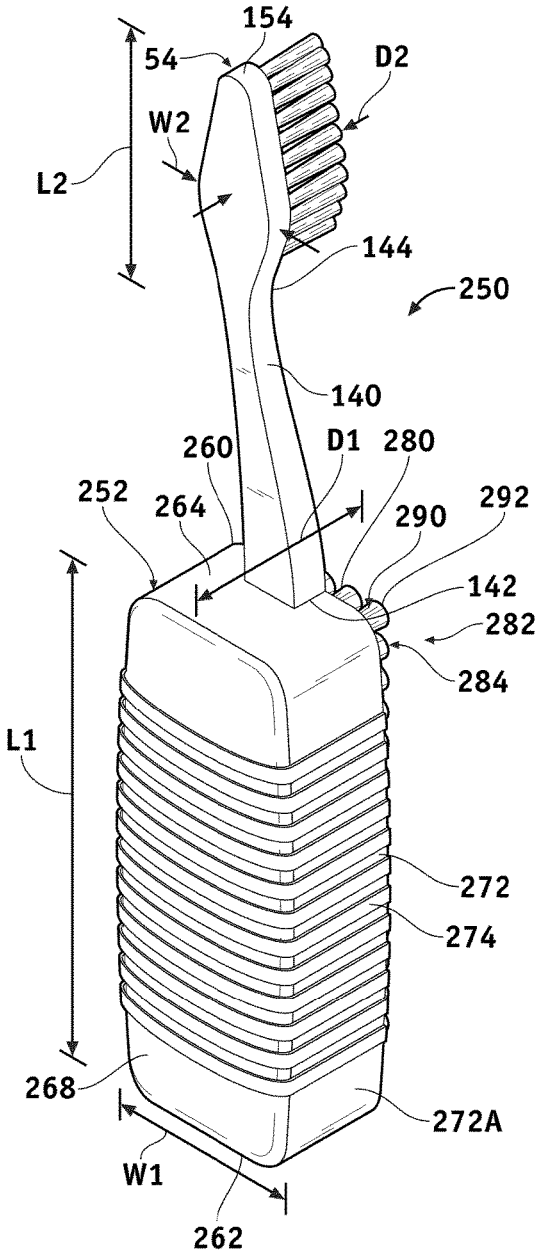
FIG. 20 is a rear perspective view of the embodiment of FIG. 19.

FIGS. 19-20 illustrate a personal care implement 250, another configuration of an exemplary embodiment constructed and arranged according to the invention. The implement includes a handle 252 and, in common with implement 50, the head assembly 54 and the elongate member 140 connecting the head assembly 54 to the handle 252. The head assembly 54 is of the size described above to facilitate and allow its reception in the mouth of the user for toothbrushing as described above. Like the handle 52, the handle 252 is of the size described above that is larger than that of the head assembly 54 to facilitate grasping and holding the handle 252 by one hand of the user as described above. In this embodiment, the handle 252 has but one scrub brush instead of two, like implement 50.

The handle 252 exemplifies a hand and fingernail scrub brush construction. It includes a body 260 of plastic, metal, wood, or other material or combination of materials with inherently strong, rigid, and resilient material characteristics. The body 260 includes a proximal end 262, a distal end 264, opposed surfaces or faces 266 and 268, and opposed sides 270 and 272. Face 266 is the body's 260 front face, face 268 is the body's 260 back face, side 270 is the body's 260 left side, and side 272 is the body's 260 right side. The body 260 is elongate from the proximal end 262 to the distal end 264 and has a rectangular shape. The opposed front and back faces 266 and 268 and the opposed sides 270 and 272 extend longitudinally of the body 60 between the proximal and distal ends 262 and 264. The opposed front and back faces 266 and 268 extend transversely of the body 60 between the sides 270 and 272. Ribs 274 protruding from the back face 268 and the outer surfaces 270A and 272A of the opposed sides 270 and 272 aid in gripping the body 260 by one hand of the user.

The implement 250 has bristles 280, attached fixedly to the body 260. The bristles 280 are flexible and resilient, of polyester, nylon, or the like, attached or embedded into the body 260 in a manner well-known in the art and form a scrub brush 282 designed for cleaning the surfaces of the hands and fingernails. The scrub brush 282 extends longitudinally of the body 260 between the proximal and distal ends 262 and 264, along a length of the body 260 from proximate to the proximal end 262 to proximate to the distal end 264, transversely of the body 260 between the sides 270 and 272, along a width of the body 60 from proximate to side 270 to proximate to side 272, and outward forwardly from the front face 266 to a forward-facing scrub-brushing extremity 284. In this example, the scrub brush 282 has a rectangular shape, its length extending longitudinally of the body 260 between the proximal end distal ends 262 and 264 being longer than its width extending transversely of the body 260 between the sides 270 and 272.

The bristles 280 are arranged in tufts 290. The tufts 290 are identical in every respect. Each tuft 290 extends forwardly of the front face 266 to a brushing extremity 292. The various tufts 290 define the scrub brush 282, and their various brushing extremities 292 define the scrub brush's 282 scrub-brushing extremity 284.

The elongate member 140 extends outward longitudinally from body's 260 distal end 264 to the head assembly 54. The elongate member 140 extends longitudinally outwardly from its inner end 142, affixed to the handle's 252 distal end 264 centrally between the opposed sides 270 and 272, to the head assembly 54. The implement 250 extends longitudinally from the proximal end 262 to the distal end 264, from the inner end 142 of the elongate member 140 to the head's 150 root end 152, and from there to the head's 150 outer end 154.

Like implement 50, the implement's 250 body 260 has length L1, extending from the proximal end 262 to the distal end 264, the width W1, extending from the outer surface 270A of the side 270 to the outer surface 272A of the side 270, and depth D1, extending from scrub-brushing extremity 282 to back face 268. Like the implement's 50 brush 122, brush 282 has a rectangular shape, brush length BL2 extending longitudinally of the body 260 between the proximal end distal ends 262 and 264 and brush width BW2 extending transversely of the body 260 between the sides 270 and 272. The implement 250 also shares the implement's 50 overall length L from the handle's 252 proximal end 262 to the head assembly's 54 outer end 154.

The implement 250 is useful for toothbrushing with the head assembly 54 and hand and fingernail washing with the handle's 252 scrub brush 282. The head assembly 54 is of the size to facilitate and allow its reception in the mouth of the user for toothbrushing as described with implement 50 while the user holds the implement 250 by its handle 252. The user holds the implement 250 by grasping its body 260 by one of his hands, such between a thumb of the hand of the user against the outer surface of one of the sides 270 and 272 and his other four fingers spaced longitudinally against the outer surface of the other one of the sides 270 and 272. The implement 250 so hand held with the scrub brush 282 directed outwardly from the palm side of the user's hand allows the user to scrub his other hand with the outwardly-facing scrub-brushing extremity 284. The user can also grasp the handle 252 for using the implement 250 for toothbrushing by wrapping his thumb and four fingers of one of his hands around the handle 252 with the palm side of the hand in direct contact against the scrub-brushing extremity 284 of the scrub brush 282, inducing the grasping reflex by the hand of the user in response to the tactile sensation produced by the scrub-brushing extremity 284 in direct contact with the palm side of the user's hand.

The implement's 250 handle 252, like implement's 50 handle 52, is designed to be grasped by one hand of the user for wielding the implement 50 according to the formats described above. The user can, of course, hold the implement 250 by its handle 252 in any way the user chooses. The body's 260 proximal end 262 is flat between the opposed faces 266 and 268 and between the opposed sides 270 and 272. This expedient allows the implement 250 to be supported upright from its proximal end 262 resting upon a horizontal supporting surface, such as the surface of a countertop, sink, etc.

The juxtaposition of the head assembly 54 and the handle's 252 scrub brush 282 beneficially remind and induce the user to scrub one of his hands and its fingernails with the scrub brush 282 of the implement 250 while holding the implement's 250 handle 252 by his other hand in conjunction with the user's regular, preferably twice daily, use of the implement 250 for toothbrushing, and vice versa. The user can switch holding the implement 250 between his hands as needed for brushing his teeth with the head assembly 54 and brushing his hands and their respective fingernails with the handle's 252 brush 282. This expedient induces and promotes a frequency of hand and fingernail washing commensurate with a frequency of toothbrushing, customarily a twice-daily routine.

The implement's 250 brush 282 is identical to the implement's 50 brush 122. Brush 282 can be formed identical to the implement's 50 brush 102 in alternate embodiments.

III

Figure 21:
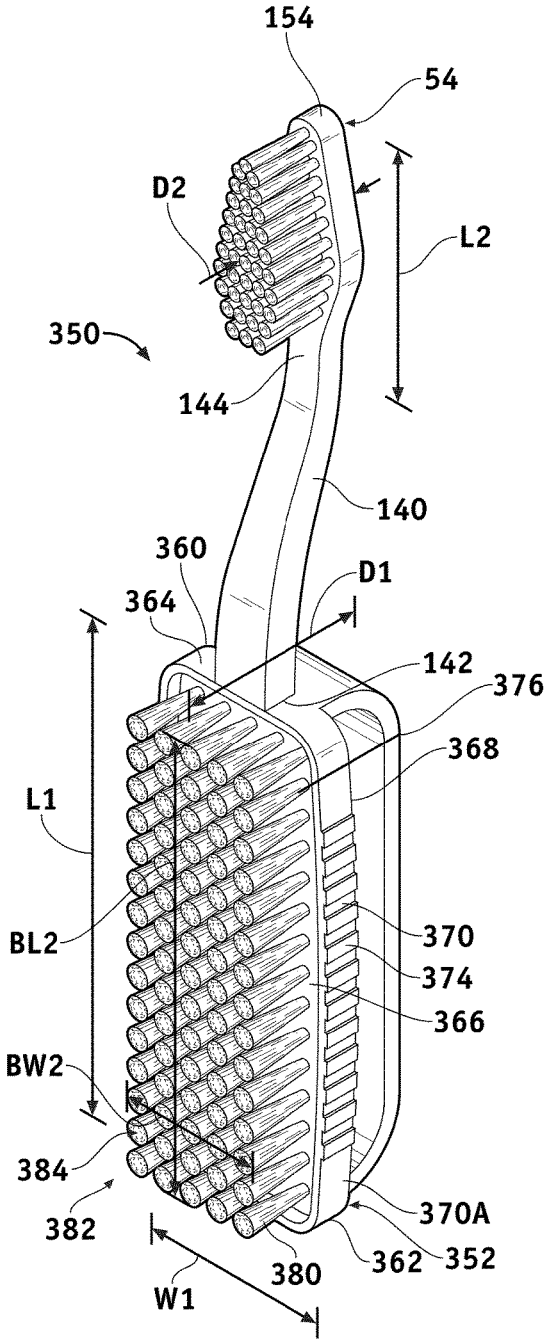
FIG. 21 is a front perspective view of a yet another embodiment of a personal care implement constructed and arranged according to the principle of the invention, the personal care implement including a handle configured with a scrub brush and an elongate member extending outward longitudinally from the handle to a toothbrush head assembly.
Figure 22:
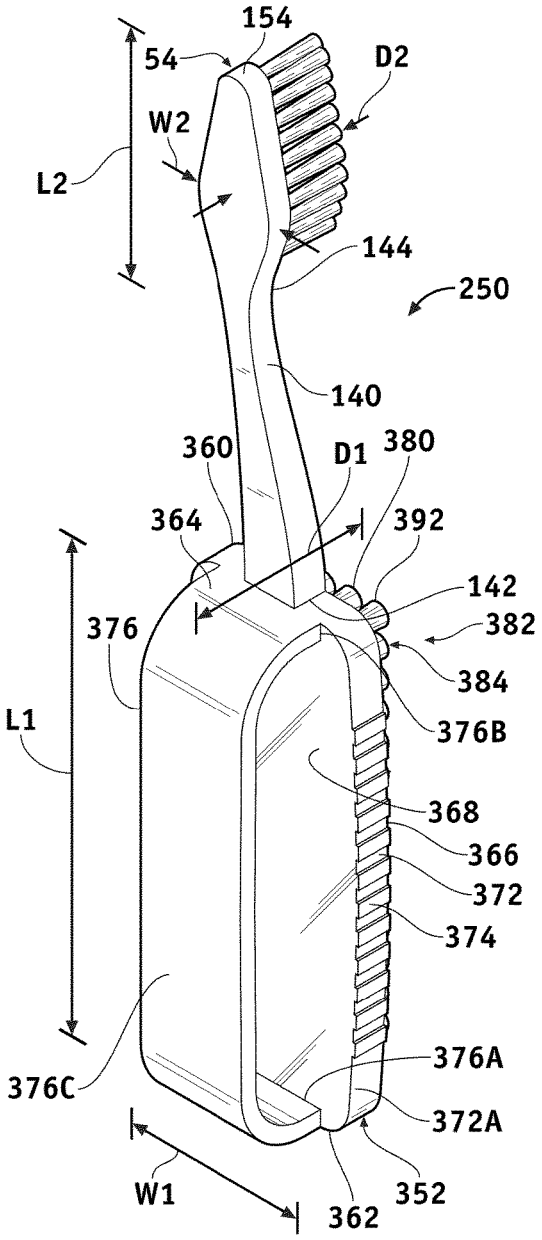
FIG. 22 is a rear perspective view of the embodiment of FIG. 21.

FIGS. 21 and 22 illustrate a personal care implement 350, yet another configuration of an exemplary embodiment constructed and arranged according to the invention. The implement 350 includes a handle 352 and, in common with implement 59, shares the head assembly 54 and the elongate member 140 connecting the head assembly 54 to the handle 352. The head assembly 54 is of the size to facilitate and allow its reception in the mouth of the user for toothbrushing as described above. Like the handle 52, the handle 352 is of the size larger than that of the head assembly 54 to facilitate grasping and holding the handle 352 by one hand of the user as described above. In this embodiment, the handle 232 has but one scrub brush instead of two, like implement 50.

The handle 352 exemplifies a hand and fingernail scrub brush construction. It includes a body 360 of plastic, metal, wood, or other material or combination of materials with inherently strong, rigid, and resilient material characteristics. The body 360 includes a proximal end 362, a distal end 364, opposed surfaces or faces 366 and 368, and opposed sides 370 and 372. Face 366 is the body's 60 front face, face 368 is the body's 360 back face, side 370 is the body's 360 left side, and side 372 is the body's 360 right side. The body 360 is elongate from the proximal end 362 to the distal end 364. The front and the back faces 366 and 368 are flat and parallel. The opposed front and back faces 366 and 368 and the opposed sides 370 and 372 extend longitudinally of the body 60 between the proximal and distal ends 362 and 364. The opposed front and back faces 366 and 368 extend transversely of the body 60 between the sides 370 and 372. Ribs 374 protruding from the outer surfaces 370A and 372A of the opposed sides 370 and 372 aid in gripping the body 360 by one hand of the user. A generally "C" shaped member 376, having ends 376A and 376B affixed rigidly to the back face 368 in FIG. 22, projects outward from the back face 368. Member 375 extends longitudinally of the body 360 from its end 376A adjacent to the body's 360 proximal end 362 to member's 376 end 376B adjacent to the body's 360 distal end 364.

The implement 350 has bristles 380, attached fixedly to the body 360. The bristles 380 are flexible and resilient, of polyester, nylon, or the like, attached or embedded into the body 360 in a manner well-known in the art and form a scrub brush 382 designed for cleaning the surfaces of the hand and fingernails. The scrub brush 382 extends longitudinally of the body 360 between the proximal and distal ends 362 and 364, along a length of the body 360 from proximate to the proximal end 362 to proximate to the distal end 364, transversely of the body 360 between the sides 370 and 372, along a width of the body 360 from proximate to side 370 to proximate to side 372, and outward forwardly from the front face 366 to a forward-facing scrub-brushing extremity 384. In this example, the scrub brush 382 has a rectangular shape, its length extending longitudinally of the body 360 between the proximal end distal ends 362 and 364 being longer than its width extending transversely of the body 360 between the sides 370 and 372.

The bristles 380 are arranged in tufts 390. The tufts 390 are identical in every respect. Each tuft 390 extends forwardly of the front face 366 to a brushing extremity 392. The various tufts 390 define the scrub brush 382, and their various brushing extremities 392 define the scrub brush's 382 scrub-brushing extremity 384.

The elongate member 140 extends outward longitudinally from body's 360 distal end 364 to the head assembly 54. The elongate member 140 extends longitudinally outwardly from its inner end 142, affixed to the handle's 352 distal end 364 centrally between the opposed sides 370 and 372, to the head assembly 54 extending longitudinally outward from the outer end 144 of the elongate member 140. The implement 350 extends longitudinally from the proximal end 362 to the distal end 364, from the inner end 142 of the elongate member 140 to the head's 150 root end 152, and from there to the head's 150 outer end 154.

Like implement 50, the implement's 350 body 360 has length L1, extending from the proximal end 362 to the distal end 364, the width W1, extending from the outer surface 370A of the side 370 to the outer surface 372A of the side 370, and depth D1, extending from scrub-brushing extremity 282 to the outermost side or surface 376C of the member 376 in FIG. 22. Like the implement's 50 brush 122, brush 382 has a rectangular shape, brush length BL2 extending longitudinally of the body 360 between the proximal end distal ends 362 and 364 and brush width BW2 extending transversely of the body 360 between the sides 370 and 372. The implement 250 also shares the implement's 50 overall length L from the handle's 352 proximal end 362 to the head assembly's 54 outer end 154.

The implement 350 is useful for toothbrushing with the head assembly 54 and hand and fingernail washing with the handle's 352 scrub brush 382. The head assembly 54 is of the size to facilitate and allow its reception in the mouth of the user for toothbrushing as described with implement 50 while the user holds the implement 250 by its handle 252. The user holds the implement 350 by grasping its body 360 by one of his hands, such between a thumb of the hand of the user against the outer surface of one of the sides 370 and 372 and his other four fingers spaced longitudinally against the outer surface of the other one of the sides 370 and 372. The implement 350 so hand held with the scrub brush 382 directed outwardly from the palm side of the user's hand allows the user to scrub his other hand with the outwardly-facing scrub-brushing extremity 384. Alternatively, the user can hold the implement 350 by grasping its member 376, the implement's 350 auxiliary handle, with one of his hands, and then employ the implement 350 for toothbrushing by the head assembly 54 and hand and fingernail washing by the scrub brush 382. The user can also grasp the handle 352 for using the implement 350 for toothbrushing by wrapping his thumb and four fingers of one of his hands around the handle 352 with the palm side of the hand in direct contact against the scrub-brushing extremity 384 of the scrub brush 282, inducing the grasping reflex by the hand of the user in response to the tactile sensation produced by the scrub-brushing extremity 384 in direct contact with the palm side of the user's hand.

The implement's 350 handle 352, like implement's 50 handle 52, is designed to be grasped by one hand of the user for wielding the implement 350 according to the formats described above. The user can, of course, hold the implement 350 by its handle 352 in any way the user chooses. The body's 360 proximal end 362 is flat between the opposed faces 366 and 368 and between the opposed sides 370 and 372. This expedient allows the implement 350 to be supported upright from its proximal end 362 resting upon a horizontal supporting surface, such as the surface of a countertop, sink, etc.

The juxtaposition of the head assembly 54 and the handle's 352 scrub brush 382 beneficially remind and induce the user to scrub one of his hands and its fingernails with the scrub brush 382 of the implement 350 while holding the implement's 350 handle 352 by his other hand in conjunction with the user's regular, preferably twice daily, use of the implement 350 for toothbrushing, and vice versa. The user can switch holding the implement 350 between his hands as needed for brushing his teeth with the head assembly 54 and brushing his hands and their respective fingernails with the handle's 352 brush 382. This expedient induces and promotes a frequency of hand and fingernail washing commensurate with a frequency of toothbrushing, customarily a twice-daily routine.

The implement's 350 brush 382 is identical to the implement's 50 brush 122. Brush 382 can be formed identical to the implement's 50 brush 102 in alternate embodiments.

IV

The present invention is described above with reference to illustrative embodiments. Those skilled in the art will recognize that changes and modifications may be made in the described embodiments without departing from the nature and scope of the present invention. Various changes and modifications to the embodiments herein chosen for purposes of illustration will readily occur to those skilled in the art. To the extent that such modifications and variations do not depart from the invention, they are intended to be included within the scope thereof.

The invention claimed is:

1. A personal care implement, comprising:

a hand and fingernail scrub brush construction comprising an elongate body including a first side and an opposed second side extending longitudinally between a proximal end and an opposed distal end and first bristles attached fixedly to the elongate body, the first bristles comprising a scrub brush extending longitudinally of the elongate body between the proximal end and the distal end, transversely of the elongate body between the first side and the second side, and outward from the elongate body to a scrub-brushing extremity;

an elongate member extending outward longitudinally from the distal end to a toothbrush head assembly, the toothbrush head assembly comprising second bristles attached fixedly to a head, the second bristles comprising a toothbrush extending outward from the head to a toothbrushing extremity;

the hand and fingernail scrub brush construction being a size and in juxtaposition with the toothbrush head assembly being a size, the size of the hand and fingernail scrub brush construction larger than the size of the toothbrush head assembly;

the size of the hand and fingernail scrub brush construction a) too big for reception in a mouth of a user for toothbrushing by the scrub brush, and b) suitable to facilitate grasping and holding the hand and fingernail scrub brush construction by one hand of the user in a first format and a second format, the first format comprising the elongate body grasped between a thumb of the hand of the user against one of the first side and the second side between the proximal end and the distal end and fingers of the hand of the user spaced longitudinally against another one of the first side and the second side between the proximal end and the distal end with the scrub brush extending outward from the hand and fingernail scrub brush construction from a palm side of the hand for hand and fingernail brushing by the scrub brush, and the second format comprising a first grip including the thumb and fingers of the hand of the user wrapped around the hand and fingernail scrub brush construction with the palm side of the hand in direct contact against the scrub-brushing extremity, inducing a grasping reflex by the hand of the user;

the size of the toothbrush head assembly c) too small to be grasped by one hand of the user in the first format and the second format, and d) suitable to facilitate reception of the toothbrush head assembly in the mouth of the user for toothbrushing by the toothbrush; and the size of the hand and fingernail scrub brush construction, the size of the toothbrush head assembly, and the juxtaposition of the hand and fingernail scrub brush construction with the toothbrush head assembly promote e) toothbrushing by the toothbrush of the toothbrush head assembly, f) hand and fingernail brushing by the scrub brush of the hand and fingernail scrub brush construction, and g) a frequency of hand and fingernail washing commensurate with a frequency of toothbrushing and vice versa.

2. The personal care implement according to claim 1, further comprising the first bristles arranged in tufts.

3. The personal care implement according to claim 1, wherein the scrub-brushing extremity is flat.

4. The personal care implement according to claim 1, wherein the first side and the second side comprise a first flange and an axially spaced apart first and second flange.

5. The personal care implement according to claim 1, further comprising:

the head including a root end and an outer end, the head extending outward longitudinally to the outer end from the root end affixed to the elongate member; and the toothbrush extending longitudinally of the head between the root end and the outer end.

6. The personal care implement according to claim 1, further comprising:

the implement including a length from the proximal end of the elongate body to an outer end of the head;

the elongate body having a width from the first side to the second side and a length from the proximal end to the distal end, the length of the elongate body at least 45% of the length of the implement;

the scrub brush having a width between the first side and the second side and a length between the proximal end and the distal end, the length of the scrub brush at least 80% of the length of the elongate body; and the width of the elongate body at least 2.5 centimeters, the length of the elongate body at least 9 centimeters, the width of the scrub brush at least 45% of the width of the elongate body, and the length of the scrub brush at least 80% of the length of the elongate body.

* * * * *